US008544123B2

(12) United States Patent
Okubo et al.

(10) Patent No.: US 8,544,123 B2
(45) Date of Patent: Oct. 1, 2013

(54) FLUSH TOILET

(75) Inventors: Mayu Okubo, Fukuoka (JP); Yoshikazu Ushijima, Fukuoka (JP); Yuichi Sato, Fukuoka (JP); Yoshinobu Kato, Fukuoka (JP); Ryosuke Hayashi, Fukuoka (JP); Shinji Shibata, Fukuoka (JP)

(73) Assignee: Toto Ltd. (JP)

( * ) Notice: Subject to any disclaimer, the term of this patent is extended or adjusted under 35 U.S.C. 154(b) by 299 days.

(21) Appl. No.: 12/441,856

(22) PCT Filed: Dec. 25, 2007

(86) PCT No.: PCT/JP2007/074827

§ 371 (c)(1),
(2), (4) Date: Mar. 18, 2009

(87) PCT Pub. No.: WO2008/081778

PCT Pub. Date: Jul. 10, 2008

(65) Prior Publication Data

US 2009/0313750 A1 Dec. 24, 2009

(30) Foreign Application Priority Data

Dec. 28, 2006 (JP) ..... 2006-354726
Jun. 28, 2007 (JP) ..... 2007-170796
Jul. 30, 2007 (JP) ..... 2007-197557

(51) Int. Cl.
*E03D 11/02* (2006.01)

(52) U.S. Cl.
USPC ..... 4/425; 4/421

(58) Field of Classification Search
USPC ..... 4/300, 329–332, 421–426
See application file for complete search history.

(56) References Cited

U.S. PATENT DOCUMENTS 5,133,089 A * 7/1992 Tsutsui et al. ..... 4/300
5,305,475 A 4/1994 Jaeckels et al.

(Continued)

FOREIGN PATENT DOCUMENTS

JP 02-132234 5/1990
JP 03-090729 4/1991

(Continued)

OTHER PUBLICATIONS

Japanese Official Action with mailing date of Oct. 19, 2009 from corresponding Japanese Patent Application No. 2008-034282 Published on Feb. 12, 2009, 6 pp.

*Primary Examiner* — Brian Glessner
*Assistant Examiner* — Paola Agudelo
(74) *Attorney, Agent, or Firm* — Brooks Kushman P.C.

(57) ABSTRACT

A flush toilet device has a toilet body having a bowl section, rim water discharge opening, a jet water discharge opening, and a discharge water trap conduit. A pressurizing pump is provided for pressurizing flush water contained in a cistern to supply it to the jet water discharge opening. A pump controller regulates the operation and rotation speed of the pressurizing pump to regulate the flow speed and flow rate of flush water discharged from the jet water discharge opening so that flush water at a first flow rate for generating a siphon effect is discharged and then at a second flow rate is discharged at the end of the siphon effect generated by the first flow rate. The second flow rate having a flow speed that can carry away human wastes and causes the siphon effect to continue by closing the cross section of any portion of the discharge water trap conduit.

9 Claims, 13 Drawing Sheets

(56) References Cited

U.S. PATENT DOCUMENTS

| | | | | | |
|---|---|---|---|---|---|
| 5,502,845 | A | * | 4/1996 | Hayashi et al. | 4/300 |
| 5,542,132 | A | | 8/1996 | Jaeckels et al. | |
| 5,608,923 | A | | 3/1997 | Jaeckels et al. | |
| 5,729,837 | A | | 3/1998 | Jaeckels et al. | |
| 5,867,844 | A | | 2/1999 | Jaeckels et al. | |
| 5,913,611 | A | | 6/1999 | Jaeckels et al. | |
| 5,983,413 | A | * | 11/1999 | Hayashi et al. | 4/420 |
| 6,115,853 | A | * | 9/2000 | Shibata et al. | 4/425 |
| 6,502,251 | B1 | * | 1/2003 | Teshima et al. | 4/300 |
| 2003/0213055 | A1 | * | 11/2003 | Yoneda et al. | 4/420 |
| 2007/0113331 | A1 | * | 5/2007 | Prokopenko et al. | 4/425 |
| 2009/0313750 | A1 | | 12/2009 | Okubo et al. | |

FOREIGN PATENT DOCUMENTS

| | | | | |
|---|---|---|---|---|
| JP | 0390750 | A | | 4/1991 |
| JP | 03090729 | A | * | 4/1991 |
| JP | 03-176523 | | | 7/1991 |
| JP | 06264482 | A | | 9/1994 |
| JP | 2774605 | B2 | | 7/1998 |
| JP | 2953002 | | | 7/1999 |
| JP | 2003-193539 | | | 7/2003 |
| JP | 2003193539 | A | | 7/2003 |
| JP | 2003213773 | A | | 7/2003 |
| JP | 2004-027507 | | | 1/2004 |
| JP | 3542622 | B2 | | 7/2004 |
| JP | 2005-264469 | | | 9/2005 |
| JP | 2005264469 | A | | 9/2005 |
| JP | 2005336796 | A | | 12/2005 |
| JP | 2006-104669 | | | 4/2006 |
| JP | 2006-241698 | | | 9/2006 |
| JP | 2006241698 | A | * | 9/2006 |
| JP | 2006241699 | A | | 9/2006 |
| JP | 2009002054 | A | * | 1/2009 |

* cited by examiner

FORMER RIM FLUSHING
JET FLUSHING
LATTER RIM FLUSHING
TANK WATER SUPPLY
5 Seconds
4 Seconds
SWITCHING VALVE: 28
RIM SIDE FULL OPEN (TANK SIDE CLOSED)
BOTH SIDES
TANK SIDE FULL OPEN (RIM SIDE CLOSED)
ELECTRO-MAGNETIC VALVE: 22
ON
OFF
UPPER END FLOAT SW: 32b
ON (FULL)
OFF
LOWER END FLOAT SW: 32c
ON
OFF
PRESSURIZING PUMP: 34
ON
OFF
rpm (ON)
OFF
1000rpm
3500rpm
3300rpm
3200rpm
t0
t1
t2
t3
t4
t5
t6
t7
t8
t9
t10
t11
t12
t13
t14
t15
t16

FLUSH TOILET

TECHNICAL FIELD

The present invention relates to a flush toilet, and more particularly to a flush toilet cleaned by pressurized flush water.

BACKGROUND ART

Conventionally, flush toilets have been known in which, as set forth in Japanese Patent 2953002 (Patent Document 1), a direct connection is made to a water main, and without the use of a tank the bowl portion is flushed using water main pressure by supplying flush water from a rim water spouting port provided on the rim of a toilet bowl portion, and from a jet water spouting port provided on the bottom portion of the bowl portion, which spouts water toward a drain trap pipe.

In addition, flush toilets have been known in which, as set forth in Patent Document 2, rim spouted water is directly supplied as water main water from a rim water spouting port, whereas jet spouted water is flush water stored in a tank and pressurized by a pump, with this pressurized flush water then being expelled from a jet water spouting port to flush the bowl portion.

In the flush toilet set forth in JP2005-264469 (Patent Document 2), on the other hand, flush water is first spouted from a rim water spouting port (rim flushing), then, after spouting from the rim water spouting port is completed, flush water is spouted from a jet water spouting port, and when spouting from the jet water spouting port is completed, flush water is again spouted from the rim water spouting port.

However, because the flush toilet set forth in Patent Document 1 supplies flush water to the toilet bowl portion using water main pressure alone, it cannot be used in localities with low water main pressure, or on the second or third floors of buildings and the like where water pressure is lower. Also, in this type of flush toilet, after the siphon action ended a relatively large volume of air was sucked from the trap pipe producing an unpleasant gurgling sound as the siphon action was cut off.

In the flush toilet set forth in Patent Document 2, flush water stored in the tank is pressurized by a pump and expelled from a jet water spouting port, thus solving the problem of non-usability in low water pressure localities or sites, but the noise problem remained unsolved.

In addition, there has long been a requirement for water conservation, and a desire for low water-use flush toilets.

At the same time, as noted above, in the flush toilet of Patent Document 2 flush water is spouted from the jet water spouting port after spouting of flush water from the rim water spouting port is completed, but because the volume of jet spouted water is low, a long time is required until the siphon effect is generated (siphon start), increasing flush water volume by that amount, such that the water conservation requirement is not satisfied.

Furthermore, as described above, in the Patent Document 1 flush toilet both the rim water spouting port and the jet water spouting port are directly connected to the water main. For this reason, the volume of flush water supplied from the water main is fixed when flush water is spouted from the jet water spouting port during spouting from the rim water spouting port (see FIG. 29 in Patent Document 1), therefore the volume of rim spout water must be reduced when spouting flush water from the jet water spouting port, resulting in less jet spouted water, thereby lengthening the time until the siphon effect is generated (siphon start), as in Patent Document 2, causing an increase by that amount in the volume of flush water and failing to satisfy the requirement for water conservation.

DISCLOSURE OF THE INVENTION

The present invention therefore has the object of providing a flush toilet which is not prone to the effects of water main pressure, has a reduced siphon cutoff sound when the siphon action stops, and satisfies the requirement for water conservation.

The present invention also has the object of providing a flush toilet capable of reducing the time required until the siphon action is generated, and of satisfying the requirement for water conservation.

To solve the above-described problems, a first invention of the present invention is a flush toilet cleaned by pressurized flush water, said flush toilet comprising a toilet main unit provided with a bowl portion, a rim water spouting port and jet water spouting port both for expelling flush water, and a drain trap pipe; a reservoir tank for storing flush water; rim spout water supply means for supplying flush water to the rim water spouting port at a predetermined timing; reservoir water supply means for supplying flush water to the reservoir tank at a predetermined timing; a pressurizing pump for pressurizing flush water stored in the reservoir tank and supplying the flush water to the jet water spouting port; and pressurizing pump control means for controlling the operation of the pressurizing pump and the rpm thereof so as to control the flow speed and the flow volume of flush water spouted from the jet water spouting port; wherein the drain trap pipe includes an inlet portion, a trap ascending pipe rising from the inlet portion, and a trap descending pipe dropping from the trap ascending pipe; the jet water spouting port is disposed approximately horizontally, pointing toward the inlet portion of the drain trap pipe; and the pressurizing pump control means controls the rpm of the pressurizing pump so that a first flow volume for generating a siphon action is spouted from the jet water spouting port, then a second flow volume is spouted, generating a flow speed capable of conveying waste, and in such a way as to seal a cross section at some location of the drain trap pipe, thereby continuing the siphon action, prior to the end of the siphon action generated by the first flow volume.

In the first invention of the present invention thus constituted, the jet water spouting port is disposed approximately horizontally, pointing toward the inlet portion of the drain trap pipe; when water is jet spouted, the pressurizing pump rpm is controlled by the pump control means, so that a siphon effect (action) is rapidly induced by spouting of the first flow volume (large flow volume); this quickly discharges accumulated water and waste in the bowl portion; before the siphon action ends, a second flow volume (large flow volume) continues to be spouted, sealing a section of some part of the drain trap pipe, essentially filling the drain trap pipe with water, thereby maintaining the siphon effect (action) continuously (push-out action), such that waste floating in the bowl portion is quickly discharged from the drain trap pipe.

As a result, since jet water spouting is performed using a pressurizing pump in the first invention of the present invention, thereby suddenly inducing a siphon action by jet spouting a large flow volume (the total flow volume of the first flow volume and the second flow volume), the jet spouted flush water volume is reduced and the water conservation requirement is met, and the siphon action is sustained by the push-out action, thus enabling the elimination of the siphon cutoff sound caused by the sucking in of a large volume of air from the drain trap pipe inlet portion at the point when accumulated water in the bowl portion has been discharged by the initial siphon action. Furthermore, because the siphon action is weaker than the initial siphon due to the push-out action, the siphon cutoff sound can be reduced, since only a weak siphon cutoff sound is generated when this weak siphon action is completed.

In the first invention of the present invention, the pump control means preferably controls the pressurizing pump rpm in such a way that the second flow volume is smaller than the first flow volume.

In the first invention of the present invention thus constituted, the second flow volume is arranged to be smaller than the first flow volume which induces the siphon effect (action), therefore the siphon effect generated can be continuously maintained at a low flow volume.

In the first invention of the present invention, the pressurizing pump control means preferably controls the rpm of the pressurizing pump in such a way that water spouted from the jet water spouting port gradually decreases when spouting of the second flow volume ends.

In the first invention of the present invention thus constituted, spouting of water from the jet water spouting port gradually decreases when spouting of the second flow volume ends, therefore the occurrence of a siphon cutoff sound caused by a sudden interruption of the siphon action due to the push-out action can be prevented.

In the first invention of the present invention, the first flow volume is preferably 75-120 liters/minute.

In the first invention of the present invention, the flow speed of the flush water spouted from the jet water spouting port by the pressurizing pump under the control of the pump control means is preferably 3.0-6.0 liters/minute.

The second invention of the present invention is a flush toilet cleaned by pressurized flush water, said flush toilet comprising a toilet main unit provided with a bowl portion, a rim water spouting port and jet water spouting port for expelling flush water, and a drain trap pipe; a reservoir tank for storing flush water; rim spout water supply means for supplying flush water to the rim water spouting port at a predetermined timing; reservoir water supply means for supplying flush water to the reservoir tank at a predetermined timing; pressurizing means for pressurizing flush water stored in the reservoir tank and supplying the flush water to the jet water spouting port; and pressurizing means control means for controlling the operation of the pressurizing means and controlling the volume pressurized by the pressurizing means so as to control the flow speed and flow volume of flush water spouted from the jet water spouting port; wherein the drain trap pipe includes an inlet portion, a trap ascending pipe rising from the inlet portion, and a trap descending pipe dropping from the trap ascending pipe; the jet water spouting port is disposed approximately horizontally, pointing toward the inlet portion of the drain trap pipe; and the pressurizing means control means controls the volume pressurized by the pressurizing means so that a first flow volume for generating a siphon action is spouted from the jet water spouting port, and a second flow volume, smaller than the first flow volume and generating a flow speed capable at least of conveying waste, is spouted prior to the end of the siphon action generated by the first flow volume.

In the present invention thus constituted, the jet water spouting port is disposed approximately horizontally, directed toward the inlet portion of the drain trap pipe, and when spouting jet water, the volume pressurized by the pressuring means is controlled by the pressurizing means control means; by first spouting a first flow volume (large flow volume), the siphon effect (action) is rapidly induced, which quickly discharges accumulated water and waste in the bowl portion; next, before the siphon action ends, waste floating in the bowl portion can be rapidly ejected from the drain trap pipe by expelling the second flow volume (large flow volume).

As a result, since jet water spouting is performed using the pressurizing pump in the second invention of the present invention, there is little susceptibility to water main pressure, and by rapidly inducing a siphon action by jet spouting a large flow volume (the first flow volume), the jet water spouting flush water volume required to generate a siphon action can be reduced and the requirement for water conservation can be met. In addition, since the second flow volume is made smaller than the first flow volume and floating waste is discharged with the smaller flow volume, water can be saved, and the sound of water being spouted from the jet water spouting port can be reduced, thereby achieving the effect of noise reduction.

In the second invention of the present invention, the pressurizing means control means preferably controls the volume pressurized by the pressurizing means so that before the siphon action ends, a second flow volume is spouted, generating a flow speed at which waste can be conveyed, and also sustaining the siphon action by sealing a section of some part of the drain trap pipe so that the interior of the drain trap pipe is essentially filled with water.

In the second invention of the present invention thus constituted, a second flow volume (large flow volume) is spouted before the siphon action generated by the first flow volume (large flow volume) ends, thus causing the cross section of some part of the drain trap pipe to be sealed so that the inside of the drain trap pipe is essentially filled with water, continuing and maintaining the siphon effect (action) (the push-out action); by this means, the siphon cutoff sound when the siphon action ends, which is produced by the sucking in of a large volume of air from the drain trap pipe inlet portion when accumulated water in the bowl portion is discharged by the initial siphon action, can be eliminated, and because the siphon action is weaker than the initial siphon caused by the push-out action, and only this weak siphon cutoff sound is produced when the weak siphon action ends, the siphon cutoff sound can be reduced.

In the second invention of the present invention, the pressurizing means control means preferably controls the volume pressurized by the pressurizing means so that before the siphon action ends, a second flow volume is spouted, generating a flow speed capable of conveying waste, and in such a way as to seal a cross section at some location of the drain trap pipe.

In the second invention of the present invention thus constituted, a second flow volume is spouted before the siphon action generated by the first flow volume (large flow volume) ends, thereby sealing a section of some part of the drain trap pipe, so there is no drawing in of a large volume of air from the inlet portion of the drain trap pipe; the siphon cutoff sound at the end of the siphon action, which is generated by the sucking in of a large volume of air from the drain trap pipe inlet portion when accumulated water in the bowl portion is discharged by siphon action, can therefore be suppressed, and a return of foul odors to the drain trap pipe from the downstream side can also be prevented.

In the second invention of the present invention, the pressurizing means control means preferably controls the volume pressurized by the pressurizing means so that before the siphon action ends, a second flow volume is spouted, generating a flow speed capable of conveying waste, without sealing a cross section at some location of the drain trap pipe.

In the second invention of the present invention thus constituted, a second flow volume is spouted before the siphon action generated by the first flow volume (large flow volume) ends; the flow of flush water therein permits a reduction in the surface area of the drain trap pipe inlet portion opening, such that there is no large volume of air drawn in, and the siphon cutoff sound at the end of the siphon action, which is generated by the sucking in of a large volume of air from the drain trap pipe inlet portion when accumulated water in the bowl portion is discharged by siphon action, can therefore be suppressed, and a return of foul odors to the drain trap pipe from the downstream side can also be prevented.

In the second invention of the present invention, wherein the pressurizing means control means preferably controls the volume pressurized by the pressurizing means so that water spouted from the jet water spouting port gradually decreases when spouting of the second flow volume from the jet water spouting port ends.

In the second invention of the present invention thus constituted, spouting from the jet water spouting port is gradually reduced when the spouting of a flow volume for the second flow volume ends, therefore the generation of a siphon cutoff sound occurring when the siphon action is suddenly interrupted can be prevented.

In the second invention of the present invention, the first flow volume is preferably between 75-120 liters/minute.

In the second invention of the present invention, the flow speed of flush water spouted from the jet water spouting port by the pressurizing means under the control of the pressurizing means control means is preferably between 3.0-6.2 meters/second.

The third invention of the present invention is a flush toilet cleaned by pressurized flush water, said flush toilet comprising a toilet main unit provided with a bowl portion, a rim water spouting port and jet water spouting port for expelling flush water, and a drain trap pipe; a reservoir tank for storing flush water; rim spout water supply means for supplying flush water to the rim water spouting port at a predetermined timing; a pressurizing pump for pressurizing flush water stored in the reservoir tank; jet spout water supply means for supplying flush water pressurized by the pressurizing pump to the jet water spouting port at a predetermined timing; and control means for controlling the rim spout water supply means, the pressurizing pump, and the jet spout water supply means to spout flush water to the bowl portion of the toilet main unit; wherein the control means controls the rim spout water supply means, the pressurizing pump, and the jet spout water supply means so that flush water is first spouted from the rim water spouting port and then, as spouting of flush water from the rim water spouting port is continued, a first flow volume generating a siphon action is spouted from the jet water spouting port.

In the present invention thus constituted, when water is jet spouted, a first flow volume generating a siphon action is spouted from the jet water spouting port in a state whereby spouting of flush water from the rim water spouting port is continued, so that by jet water spouting with the level of accumulated water in the bowl portion and in the in the drain trap pipe raised by rim water spouting, a siphon action can be induced in a short period of time, and a strong siphon action can be generated. This enables a reduction in the flush water volume of jet spouting water used to start the siphon action, thus enabling water conservation.

In the third invention of the present invention the jet water spouting port is preferably disposed horizontally, pointing toward the inlet portion of the drain trap pipe.

In the third invention of the present invention thus constituted, because the jet water spouting port is disposed horizontally pointing toward the inlet portion of the drain trap pipe, flush water spouted from the jet water spouting port flows smoothly into the drain trap pipe, and a siphon action can be generated at an early stage.

In the third invention of the present invention, the control means preferably controls the rim spout water supply means, the pressurizing pump, and the jet spout water supply means in such a way that after the first flow volume generating a siphon action is spouted from the jet water spouting port, prior to the end of the siphon action generated by the first flow volume, a second flow volume is spouted which is smaller than the first flow volume and generates at least a flow speed capable of conveying waste.

In the third invention of the present invention thus constituted, waste floating in the bowl portion can be rapidly discharged from a drain trap pipe by spouting a second flow volume, smaller than the first flow volume and generating a flow speed capable of at least conveying waste, prior to the end of the siphon action generated by the first flow volume.

In the third invention of the present invention the rim spout water supply means preferably spouts flush water from a rim water spouting port under water main supply pressure.

In the third invention of the present invention thus constituted, it is sufficient for the pressurizing pump to have the capability of supplying the necessary volume of water to the jet water spouting port, therefore the pressurizing pump can be reduced in size, as can the capacity of the reservoir tank.

In the third invention of the present invention the control means preferably causes the pressurizing pump to rotate at a predetermined low speed so as to discharge remaining air within the water supply path connecting the pressurizing pump and the jet water spouting port, prior to spouting the first flow volume of flush water from the jet water spouting port.

In the third invention of the present invention thus constituted, the pressurizing pump is rotated at a predetermined low speed to discharge the remaining air in the supply pipe connecting the pressurizing pump and the jet water spouting port, therefore the sound of air being discharged can be prevented from occurring in the jet water spouting port. Also, since a flow into the drain trap pipe caused by rim water spouting arises at this point, air discharged from the supply pipe flows smoothly into the drain trap pipe, and the exploding air sound arising at the time of discharge into the bowl portion can be suppressed. Additionally, because the pressurizing pump is rotated at the low speed, the accumulated water level resulting from rim water spouting can be kept at a high level, and maintained until the next first flow volume jet water spouting.

In the third invention of the present invention the control means preferably controls the rim water supply means so that when water is spouted from the jet water spouting port, water continues to be spouted from the rim water spouting port.

In the third invention of the present invention thus constituted, water spouting from the rim water spouting port is continued when water is spouted from the jet water spouting port, therefore an influx of air to the inlet portion of the drain trap pipe is impeded, and the siphon cutoff sound can be suppressed. By jet spouting water while gathering floating waste at the center of the accumulated water, adhesion of floating waste to the bowl surface can be prevented and floating waste can be reliably discharged.

In the third invention of the present invention the control means preferably controls the rim spout water supply means, the pressurizing pump, and the jet spout water supply means so that the total of the flow volume spouted from the rim water spouting port and the first flow volume spouted from the jet water spouting port is between 75-120 liters/minute.

In the third invention of the present invention, the flow speed of flush water spouted from the jet water spouting port by the pressurizing pump is preferably between 3.0-6.2 meters/second.

The fourth invention of the present invention is a flush toilet cleaned by pressurized flush water, said flush toilet comprising: a toilet main unit provided with a bowl portion, a rim water spouting port and jet water spouting port for expelling flush water, and a drain trap pipe; a reservoir tank for storing flush water; a pressurizing pump for pressurizing flush water stored in the reservoir tank; rim spout water supply means for supplying flush water pressurized by the pressurizing pump to the rim water spouting port at a predetermined timing; jet spout water supply means for supplying flush water pressurized by the pressurizing pump to the jet water spouting port at a predetermined timing; and control means for controlling the rim spout water supply means, the pressurizing pump, and the jet spout water supply means to spout flush water to the bowl portion of the toilet main unit; wherein the control means controls the rim spout water supply means, the pressurizing pump, and the jet spout water supply means so that flush water is first spouted from the rim water spouting port and then, as spouting of flush water from the rim water spouting port is continued, a first flow volume generating a siphon action is spouted from the jet water spouting port.

In the present invention thus constituted, a first flow volume generating a siphon action is spouted from the jet water spouting port as spouting of flush water from the rim water spouting port is continued, therefore by spouting jet water with an elevated accumulated water level in the bowl portion and the drain trap pipe, a siphon action can be induced in a short time period, and a strong siphon action can be generated. This permits a reduction in the flush water volume of that spout water used to induce the siphon effect, thereby achieving water conservation. In addition, because in the present invention flush water stored in a reservoir tank is pressurized by a pressurizing pump and spouted from a rim water spouting port and a jet water spouting port, flushing of the toilet main unit is not affected by water main pressure.

The flush toilet of the present invention is not susceptible to water main pressure, therefore the siphon cutoff sound (noise) generated when the siphon action ends can be reduced, and the requirement for water conservation can be met.

In addition, the time up until the siphon action is generated can be reduced in the flush toilet of the present invention, thereby meeting the requirement for water conservation.

BEST MODE FOR CARRYING OUT THE INVENTION

Next, referring to the attached drawings, a flush toilet according to an embodiment of the present invention will be described.

Figure 1:
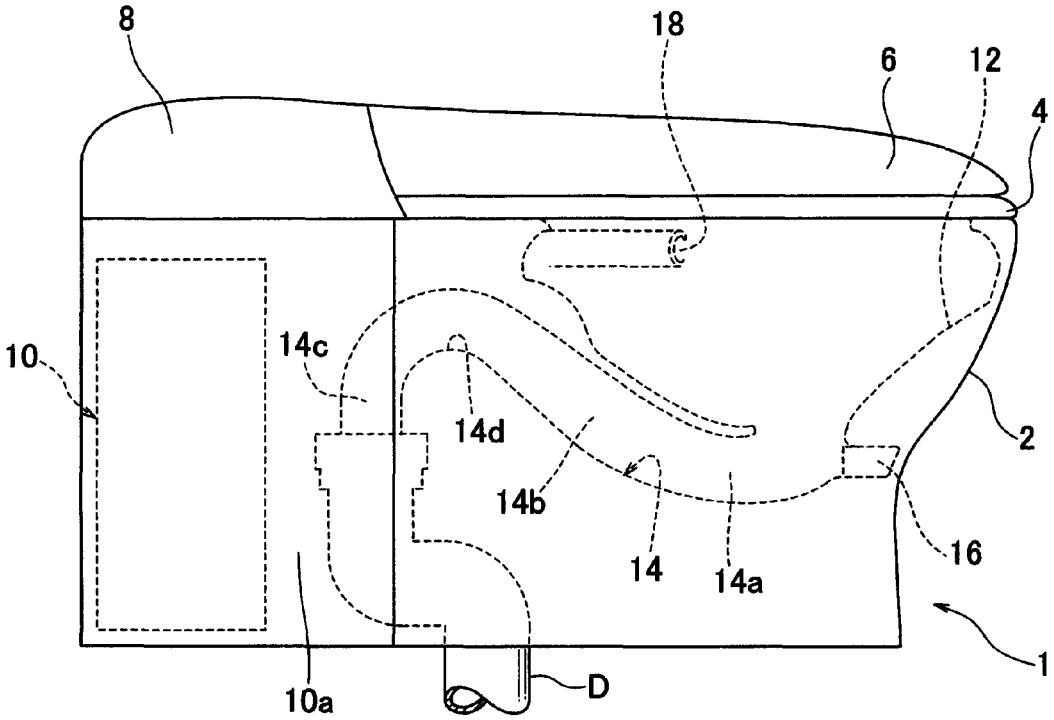
FIG. 1 is a side elevation view showing a flush toilet according to a first embodiment of the present invention.
Figure 2:
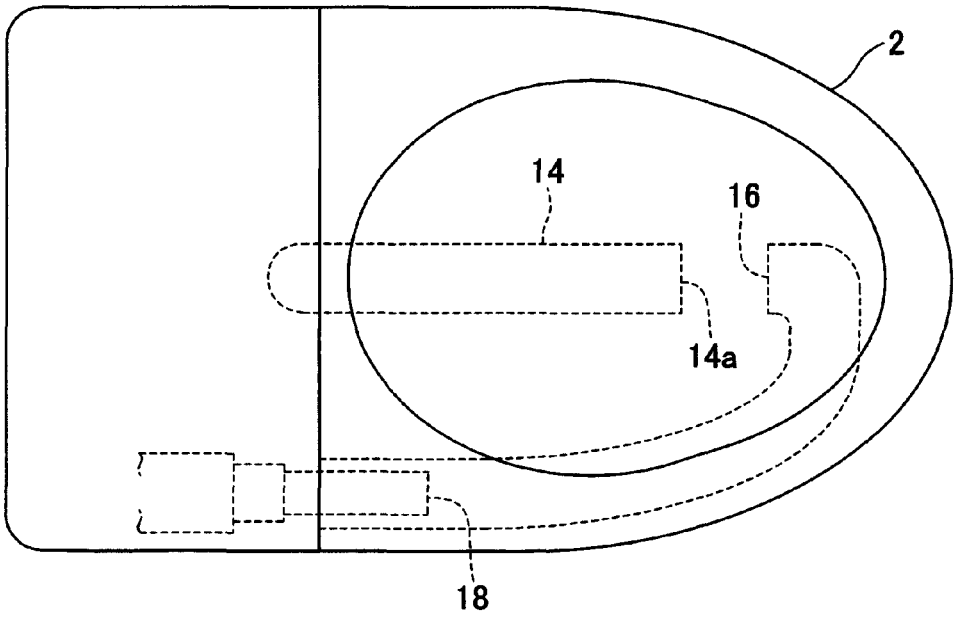
FIG. 2 is a plan view of the FIG. 1 flush toilet.
Figure 3:
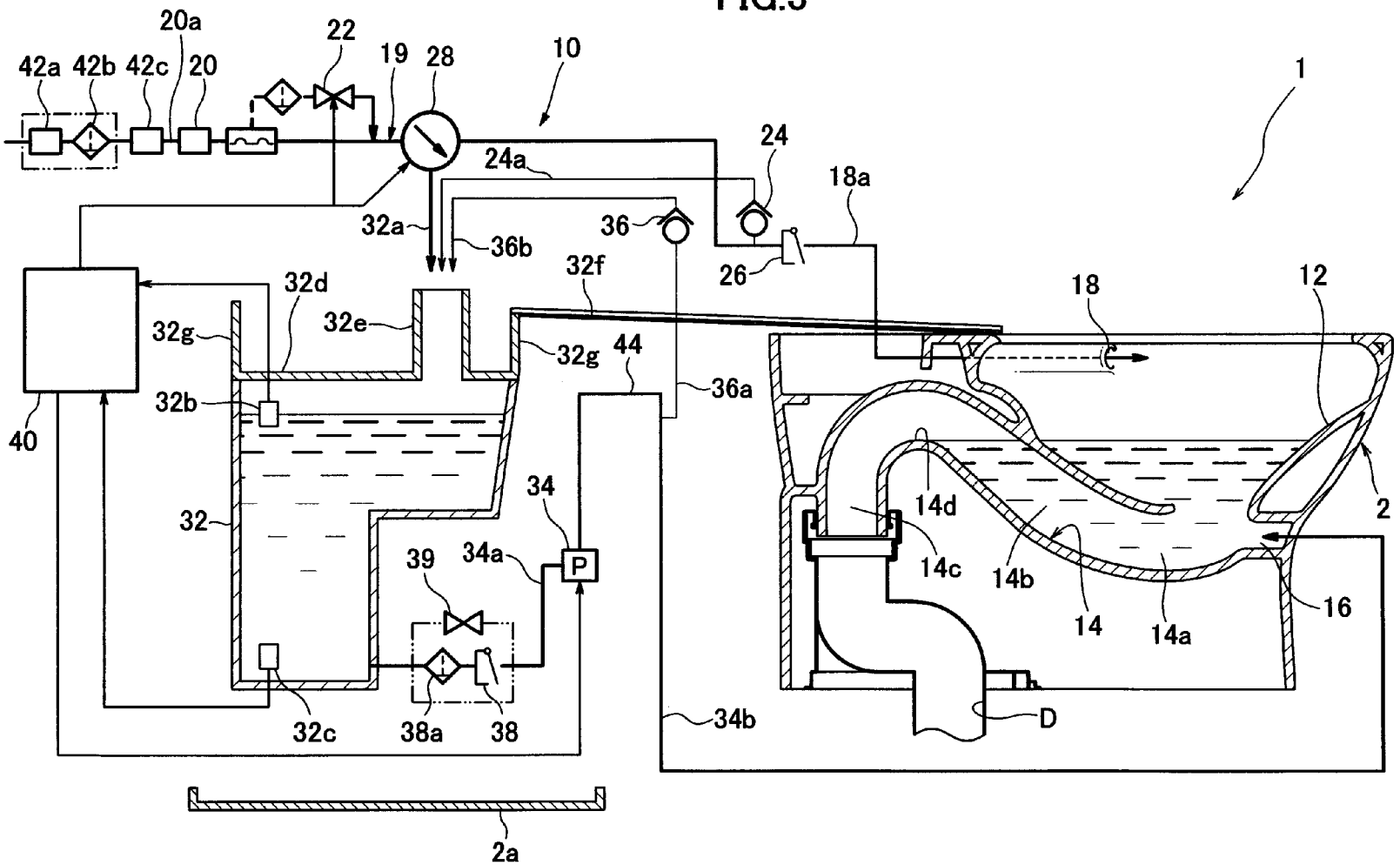
FIG. 3 is a schematic overview showing a flush toilet according to a first embodiment of the present invention.

First the structure of a flush toilet according to a first embodiment of the present invention will be described with reference to FIGS. 1 through 3. Here, FIG. 1 is a side elevation view showing a flush toilet according to the present invention; FIG. 2 is a plan view showing the flush toilet shown in FIG. 1, and FIG. 3 is a schematic overview showing the flush toilet shown in FIG. 1.

As shown in FIGS. 1 and 2, the flush toilet 1 according to the first embodiment of the present invention comprises a toilet main unit 2, a toilet seat 4 disposed on the upper surface of the toilet main unit 2, a cover 6 disposed so as to cover the toilet seat 4, and an outer flushing device 8 disposed at the rear upper portion of the toilet main unit 2. In addition, a functional portion 10 is disposed at the rear of the toilet main unit 2, and the functional portion 10 is covered by side panels 10*a*.

The toilet main unit 2 is ceramic, formed on the toilet main unit 2 are a bowl portion 12 for receiving waste, a drain trap pipe 14 extending from the bottom portion of the bowl portion 12, a jet water spouting port 16 for jet water spouting, and a rim water spouting port 18 for rim water spouting.

The jet water spouting port 16 is formed at the bottom of the bowl portion 12, configured to expel flush water toward the inlet to the drain trap pipe 14, and disposed approximately horizontally, pointing toward the inlet of the drain trap pipe 14 so as to expel flush water toward the drain trap pipe 14.

The rim water spouting port 18 is formed at the left side upper rear of the bowl portion 12, and expels flush water along the edge of the bowl portion 12.

The drain trap pipe 14 comprises an inlet portion 14*a*, a trap ascending pipe 14*b* rising from the inlet portion 14*a*, and a trap descending pipe 14*c* dropping from the trap ascending pipe connecting port 14*b*, between the trap ascending pipe 14*b* and the trap descending pipe 14*c* is a peak portion 14*d*.

The flush toilet 1 is directly connected to a water main supplying flush water, flush water is expelled from a rim water spouting port 18 under water main supply pressure. As discussed below, jet water spouting is accomplished by expelling from a jet water spouting port 16 a large volume of flush water stored in a reservoir tank 32 built into a functional portion 10 and pressurized by a pressurizing pump 34.

Next the functional portion 10 according to the first embodiment will be described in detail.

As shown in FIG. 3, a constant volume valve 20, an electromagnetic valve 22, a rim spout water vacuum breaker 24, and a rim spout water flapper valve 26 are provided on the functional portion 10. In addition, built into a water supply path 19 are a switching valve 28 for switching between supplying the tank and rim water spouting, a reservoir tank 32, a pressurizing pump 34, a jet water spouting vacuum breaker 36, a jet water spouting flapper valve 38, and a water drain plug 39. Also built into the functional portion 10 is a controller 40 for controlling the switching operation of the switching valve 28 and the rpm and operating time, etc. of the pressurizing pump 34.

The purpose of the constant volume valve 20 is to constrict to a predetermined flow volume or below the flush water flowing from the water inlet 20*a* through a stopcock 42*a*, a strainer 42*b*, and a splitter hardware 42*c*. In the present embodiment, the constant volume valve 20 limits the flow volume of flush water to 16 liters/minute or less. Flush water which has passed through the constant volume valve 20 flows into the electromagnetic valve 22, flush water which has passed through the electromagnetic valve 22 is supplied to the rim water spouting port 18 or the reservoir tank 32 by the switching valve 28. This switching valve 28 can supply flush water to both the rim-side water supply path 18*a* on the rim side and the tank-side water supply path 32*a* on the tank side at the same timing, and is capable of freely changing the proportion of supply volume to the rim side and the tank side.

The electromagnetic valve 22 is opened and closed by a controller 40 control signal, and serves to allow supplied flush water to flow into the switching valve 28, or to stop that flow.

The switching valve 28 is switched by a control signal from the controller 40, flush water flowing in through the electromagnetic valve 22 is expelled from the rim water spouting port 18, or is caused to flow into the reservoir tank 32.

The rim spout water vacuum breaker 24 is disposed midway along the rim-side water supply path 18*a*, which guides flush water which has passed through the switching valve 28 toward the rim water spouting port 18, it functions to prevent flush water back flow from the rim water spouting port 18. The rim spout water vacuum breaker 24 is disposed above the top edge surface of the bowl portion 12, and reliably prevents back flow. In addition, flush water overflowing from the atmosphere opening portion on the rim spout water vacuum breaker 24 flows into the reservoir tank 32 through a return pipe return pipe 24*a*.

The rim spout water flapper valve 26 is disposed on the rim spout water vacuum breaker 24 downstream rim-side water supply path 18*a*, and prevents back flow of flush water from the rim water spouting port 18. In the present embodiment, flush water back flow is more reliably prevented by connecting the rim spout water vacuum breaker 24 and the rim spout water flapper valve 26 in series to the rim water spouting port 18.

The reservoir tank 32 is constituted to store flush water to be spouted from the jet water spouting port 16. Note that in the present embodiment, the reservoir tank 32 has a capacity of appropriate 2.5 liters.

Furthermore, the end (lower end) of the tank-side water supply path 32*a* is opened at a position above the reservoir tank 32, and prevents back flow from the reservoir tank 32 to the tank-side water supply path 32*a*. An upper end float switch 32*b* and a lower end float switch 32*c* are disposed inside the reservoir tank 32, and detect the water level inside the reservoir tank 32. The upper end float switch 32*b* turns ON when the water level in the reservoir tank 32 reaches a predetermined stored water level; the tank water supply vacuum breaker 30 senses this and causes the electromagnetic valve 22 to close. The lower end float switch 32*c*, meanwhile, turns ON when the water level in the reservoir tank 32 drops to a predetermined level; this is sensed by the tank water supply vacuum breaker 30, which stop the pressurizing pump 34.

A covering body 32*d* is attached to the opening portion at the top end of the upper portion of the reservoir tank 32, creating a water tight seal between the exterior perimeter of the covering body 32*d* and the inner wall surface of the upper portion of the reservoir tank 32. Furthermore, a cylinder body 32*e* is attached in an upwardly extending manner to a wall surface 32*g* above the reservoir tank 32 covering body 32*d* so as to surround a circular hole provided in the covering body 32*d*.

The reservoir tank 32 wall surface 32*g* extends to a point above the covering body 32*d*, and flush water overflowing from the reservoir tank 32 cylinder body 32*e* collects on top of the covering body 32*d*. A drain path 32*f* is connected to the wall surface 32*g*, which is above the reservoir tank 32 covering body 32*d*, so that flush water collected over the covering body 32*d* can be drained into the bowl portion 12.

The pressurizing pump 34 pressurizes flush water stored in the reservoir tank 32, causing it to be expelled from the jet water spouting port 16. The pressurizing pump 34 is connected by a flush water pipe 34*a* extending from the bottom portion of the reservoir tank 32, and serves to pressurize the flush water stored in the reservoir tank 32. Note that in the present embodiment the pressurizing pump 34 pressurizes the flush water in the reservoir tank 32, causing the flush water to be expelled from the jet water spouting port 16 at a maximum flow volume of appropriate 120 liters/minute.

A jet water spouting flapper valve 38, which serves as a check valve, and a water drain plug 39 are provided midway along the flush water pipe 34*a*. This jet water spouting flapper valve 38 and water drain plug 39 are disposed at a height in the vicinity of the lower end portion of the reservoir tank 32, below the pressurizing pump 34. Therefore flush water in the reservoir tank 32 and the pressurizing pump 34 can be drained for maintenance or the like by opening the water drain plug 39. By disposing a jet water spouting flapper valve 38 between the reservoir tank 32 and the pressurizing pump 34, flush water can be prevented from flowing back from the pressurizing pump 34 into the reservoir tank 32 when the water level in the reservoir tank 32 becomes lower than the height of the pressurizing pump 34, emptying the pressurizing pump 34 of flush water.

At the same time, the outflow port on the pressurizing pump 34 is connected to the jet water spouting port 16 at the bottom portion of the bowl portion 12 through a flush water pipe 34*b*. A protruding shape is formed midway along the flush water pipe 34*b*, and a flush water pipe peak portion 44, which is the highest part of this protrusion, is the highest part of the flush water pipe from the reservoir tank 32 to the jet water spouting port 16.

The jet water spouting vacuum breaker 36 is connected to a branching pipe 36*a* which branches off from the downstream side of the pressurizing pump 34 and the flush water pipe peak portion 44, in addition to preventing back flow of accumulated water in the bowl portion 12 to the reservoir tank 32 side, this forms a partition between those elements. Flush water overflowing from the atmosphere opening portion of the jet water spouting vacuum breaker 36 flows through a return pipe 36*b* into the reservoir tank 32.

The controller 40, through operation by the operator of a toilet flushing switch (not shown), sequentially activates the electromagnetic valve 22, the switching valve 28, and the pressurizing pump 34, and sequentially starts the spouting of water from the rim water spouting port 18 and the jet water spouting port 16, flushing the bowl portion 12. Furthermore, the controller 40 releases the electromagnetic valve 22 after flushing is completed, switching the switching valve 28 over to the reservoir tank 32 side and replenishing flush water to the reservoir tank 32. When the water level in the reservoir tank 32 rises and a predetermined stored water volume is detected by the upper end float switch 32*b*, the controller 40 doses the electromagnetic valve 22 and stops supplying water.

Next, the operation of the flush toilet 1 will be described. First, the basic operation of a flush toilet 1 will be explained with reference to FIG. 4.

Figure 4:
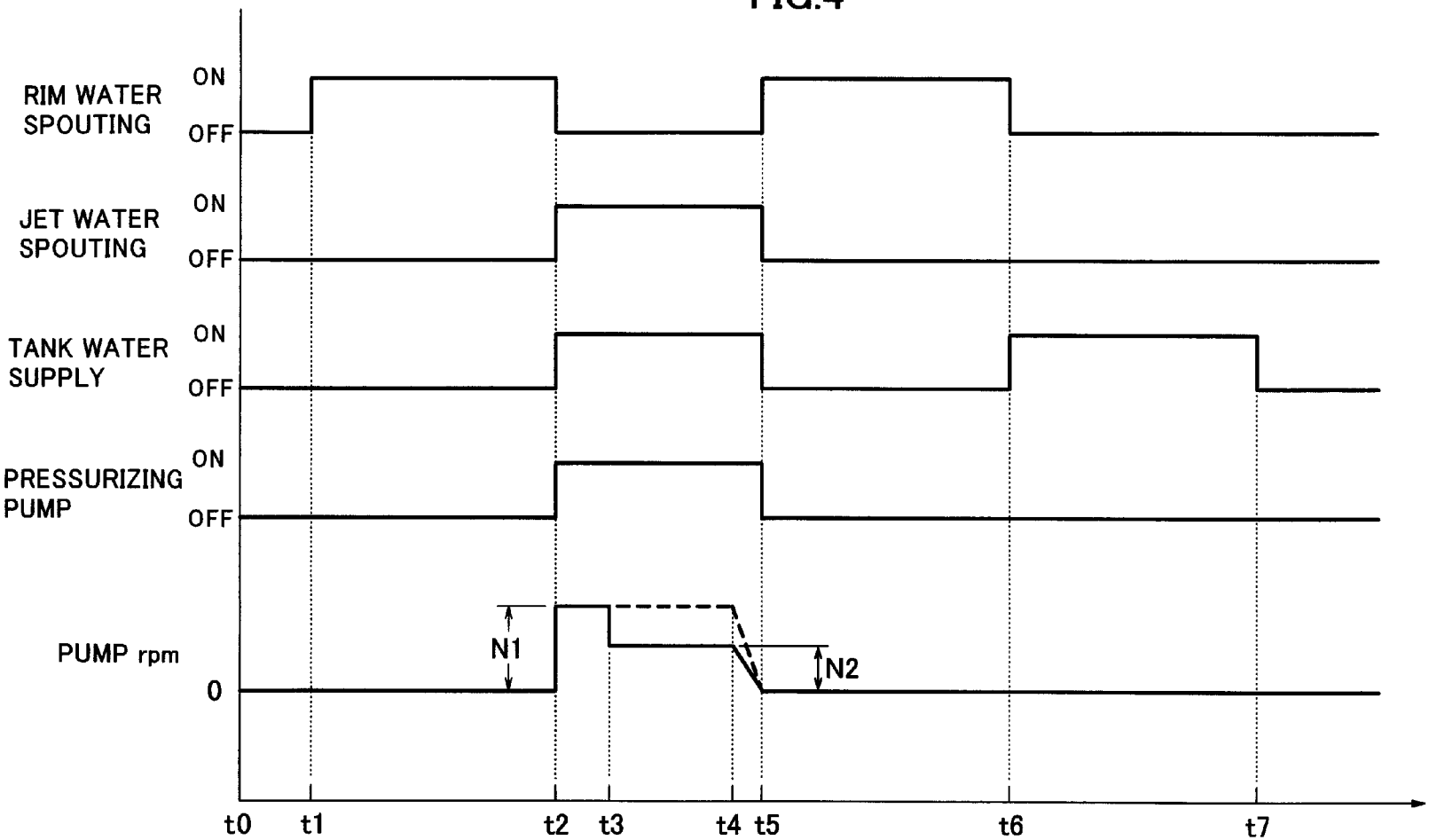
FIG. 4 is a timing chart showing the basic operation of a flush toilet according to a first embodiment of the present invention.

As shown in FIG. 4, in the standby state (time t0-t1), the first rim water spouting (pre-rim flush) is commenced when the flush toilet switch (not shown) is operated (time t1). That is, when the user operates the toilet flushing switch (not shown), a signal is sent to the electromagnetic valve 22 to open, the switching valve 28 is switched over to the rim water spouting port 18 side, and flush water from the rim water spouting port 18 is expelled by water main pressure. When the electromagnetic valve 22 is released, flush water supplied from the water main flows into the constant volume valve 20 from the water inlet 20*a* through the stopcock 42*a*, the strainer 42*b*, and the splitter hardware 42*c*. In the constant volume valve 20, the flow volume of flush water passing through is restricted when the water main supply pressure is high, and flush water passes through as is without being restricted when the water main supply pressure is low. Flush water which has passed through the constant volume valve 20 then passes through the electromagnetic valve 22 and the switching valve 28, the rim spout water vacuum breaker 24, the rim spout water flapper valve 26, and the rim-side water supply path 18*a*, and is expelled from the rim water spouting port 18 opened on the rear left side of the upper portion of the bowl portion 12. Flush water expelled from the rim water spouting port 18 flows downward as it swirls within the bowl portion 12, thereby flushing the inner wall surface of the bowl portion 12.

Thereafter (time t2), jet water spouting is commenced, while at the same time replenishment of flush water to the reservoir tank 32 is also commenced.

First, the controller 40 sends a signal to the pressurizing pump 34 to start up, holding the pump rpm at N1. When the pressurizing pump 34 is started, flush water which had been stored in the reservoir tank 32 flows through the jet water spouting flapper valve 38 and the water drain plug 39 into the pressurizing pump 34 and is pressurized. Flush water pressurized by the pressurizing pump 34 passes through the flush water pipe 34*b* flush water pipe peak portion 44 and is expelled from the jet water spouting port 16 opened at the bottom portion of the bowl portion 12.

At this point, air accumulated in the vicinity of the flush water pipe 34*b* flush water pipe peak portion 44 passes through the branching pipe 36*a* and reaches the jet water spouting vacuum breaker 36, where it is released from the air release portion.

Flush water expelled from the jet water spouting port 16 flows into the drain trap pipe 14, filling the drain trap pipe 14 and inducing a siphon effect. This siphon effect causes the accumulated water and waste in the bowl portion 12 to be sucked into the drain trap pipe 14 and discharged from the drain pipe D. In the present embodiment the pressurizing pump 34 is first rotated at a pump rpm of N1 (time t2-t3), and can expel flush water from the jet water spouting port 16 at a high flow volume of between 75 liters/minute-120 liters/minute as the pressurizing force increases, by this means a siphon effect within the drain trap pipe 14 is suddenly induced, and accumulated water and waste in the bowl portion 12 is quickly discharged.

Thereafter (time t3), the pressurizing force is slightly reduced by reducing the pump rpm down to N2, and flush water continues to be expelled from the jet water spouting port 16 at a large flow volume of less than 60 liters/minute-120 liters/minute (corresponding to the "first pattern" by "second flow volume" in the third embodiment discussed below). This allows the siphon action generated by the large flow volume of flush water expelled at a pump rpm of N2 by the "push-out action" discussed below to be continued even longer, thereby enabling the quick discharge of floating waste remaining in the bowl portion.

Moreover, the pump rpm N2 achieves the flow speed value necessary for the jet water spout to convey waste to the drain trap pipe 14 peak portion 14*d* (3.0 meter/second-6.2 meters/second).

Note that in the present embodiment, as shown by the dotted line in FIG. 4, the pump rpm can also be held as is at N1, without a reduction to N2 (time t3-t4).

In addition, in the present embodiment the pressurizing pump rpm is controlled so that spouting of water from the jet water spouting port is gradually decreased when jet water spouting at pump rpm N2 ends (time t4-45).

This enables the prevention of a large siphon cutoff sound caused by a sudden interruption of the siphon action.

When the pressurizing pump 34 is thus operated for a predetermined time (time t2-t5), flush water is spouted from the jet water spouting port 16 and the volume of stored water in the reservoir tank 32 goes to approximately 0. Spouting from the jet water spouting port 16 is stopped when the pressurizing pump 34 is stopped (time t5). Atmospheric air is thus introduced from the jet water spouting vacuum breaker 36 into the flush water pipe, and flush water is partitioned between the bowl portion 12 and the reservoir tank 32.

In the first embodiment, replenishment of the reservoir tank 32 occurs simultaneously during the period of jet water spouting (time t2-t5). At this point the controller 40, while maintaining the electromagnetic valve 22 in a released state, sends a signal to the switchover valve 28, switching this over to the tank side. Since the electromagnetic valve 22 is released, flush water flowing in from the water inlet 20*a* passes through the constant volume valve 20, the electromagnetic valve 22, the switching valve 28, and the tank-side water supply path 32*a*, flowing into the reservoir tank 32 from the end of the tank-side water supply path 32*a*.

Next, when spouting ends (time t5), the controller 40 sends a signal to the electromagnetic valve 22 releasing it and commencing the second water spouting from the rim water spouting port 18 (latter rim flush). The level of accumulated water in the bowl portion 12 rises to due to the second spouting from the rim water spouting port 18, and the inside of the bowl portion 12 reaches a predetermined accumulated water level after a predetermined rim water spouting time has elapsed (time t6).

After the second rim water spouting has ended (time t6), flush water is again replenished to the reservoir tank 32. At this point, as described above, the controller 40, with electromagnetic valve 22 in a released state, sends a signal to the switching valve 28, switching this to the tank side so that the flush water flows into the reservoir tank 32.

When flush water is replenished into the reservoir tank 32 and the water level in the reservoir tank 32 reaches a predetermined stored water level, the float switch 32*b* turns ON. When the float switch 32*b* turns ON, the controller 40 sends a signal to the electromagnetic valve 22 to close.

Figure 8:
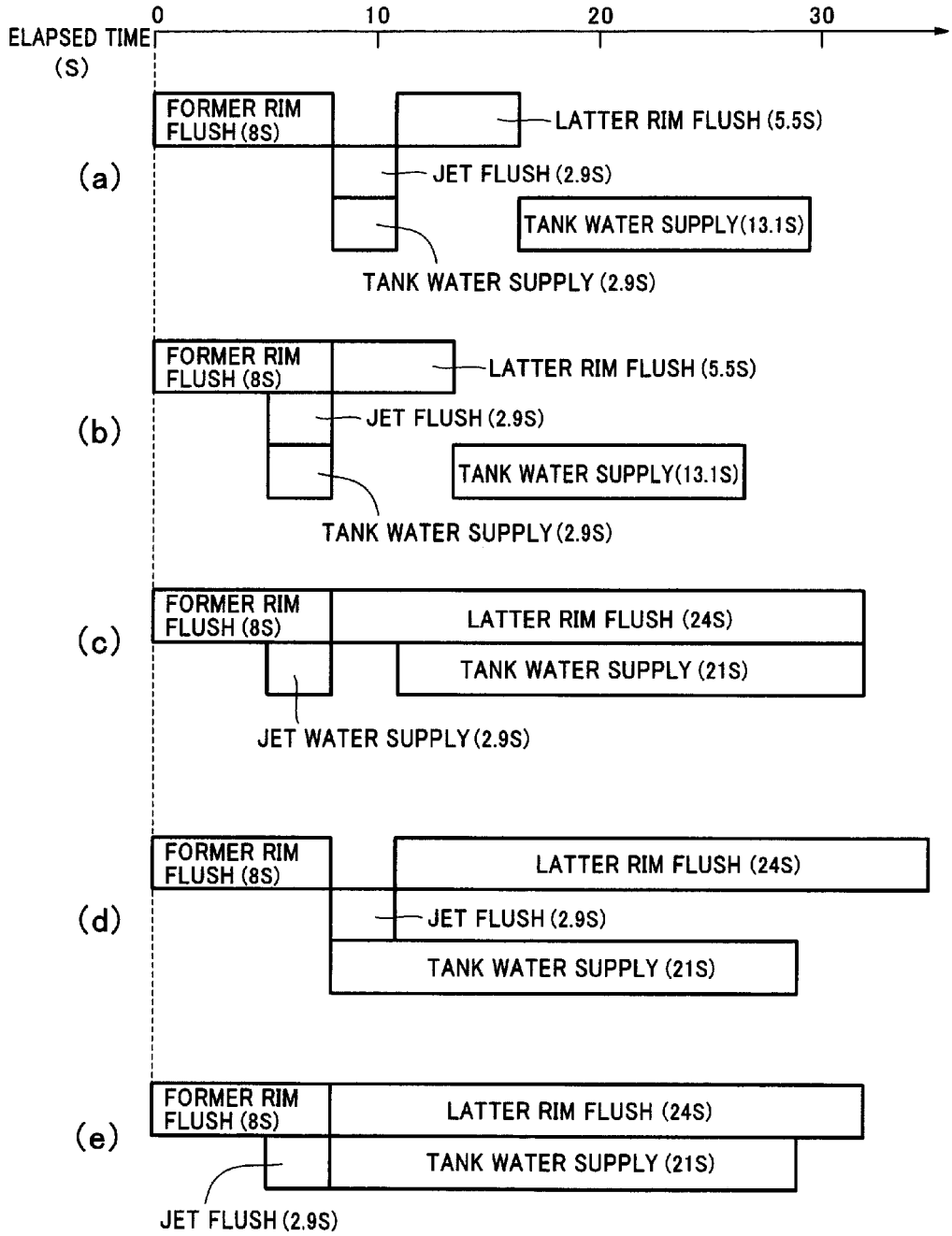
FIG. 8 is a timing chart showing timing examples of rim water spouting (former rim flushing and latter rim flushing), jet water spouting (jet flushing), and tank water supply applicable to a first embodiment and/or a second embodiment of the present invention.

The values for the times t1-t7 shown in FIG. 4, as shown in FIG. 8(*a*) explained below, are preferably t=0 sec, t1-t2=8 sec, t2-5=2.9 sec, t5-t6=5.5 sec, and t6-t7=13.1 sec.

Figure 5:
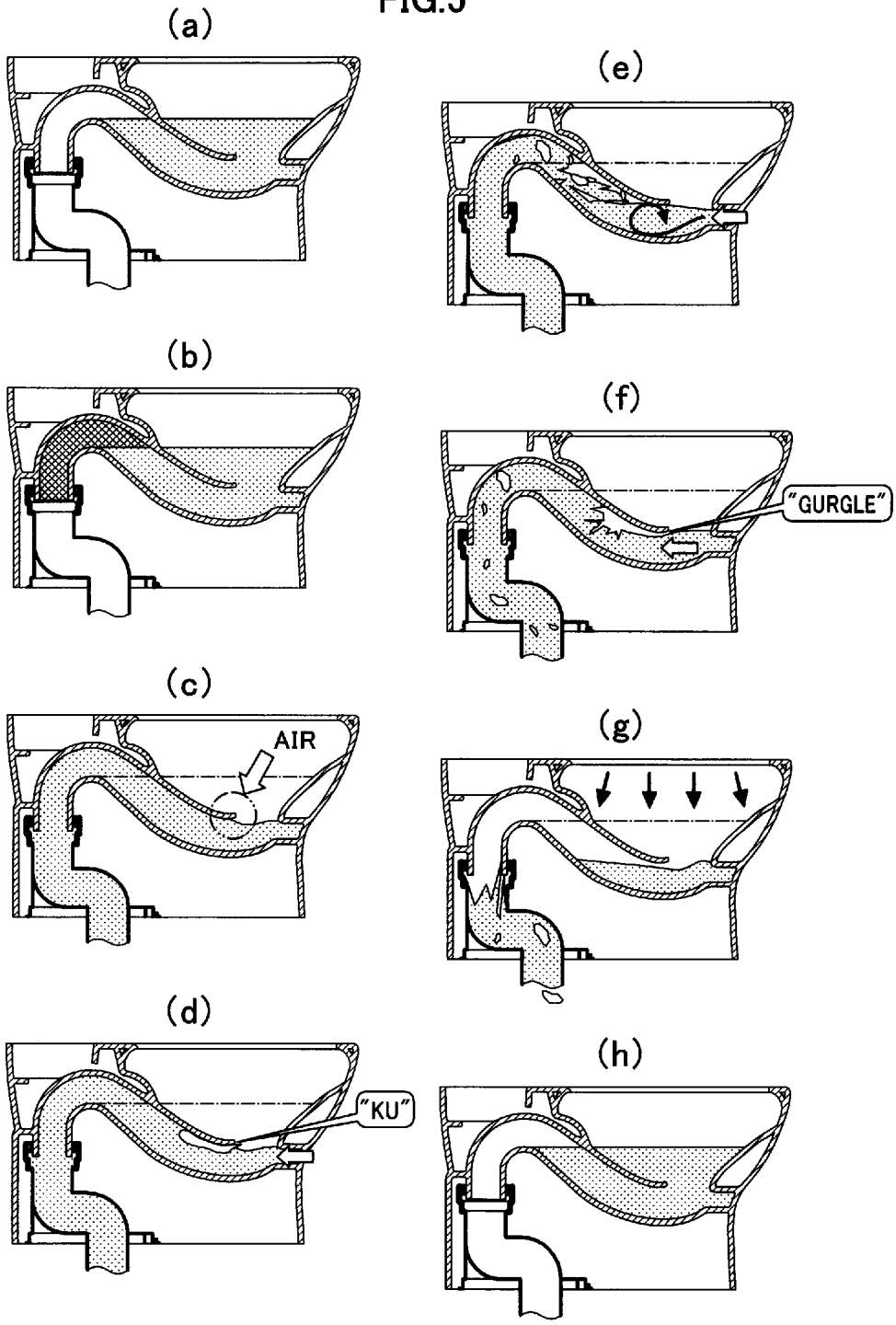
FIG. 5 is a view explaining the siphon action and push-out action of a flush toilet according to a first embodiment of the present invention.
Figure 6:
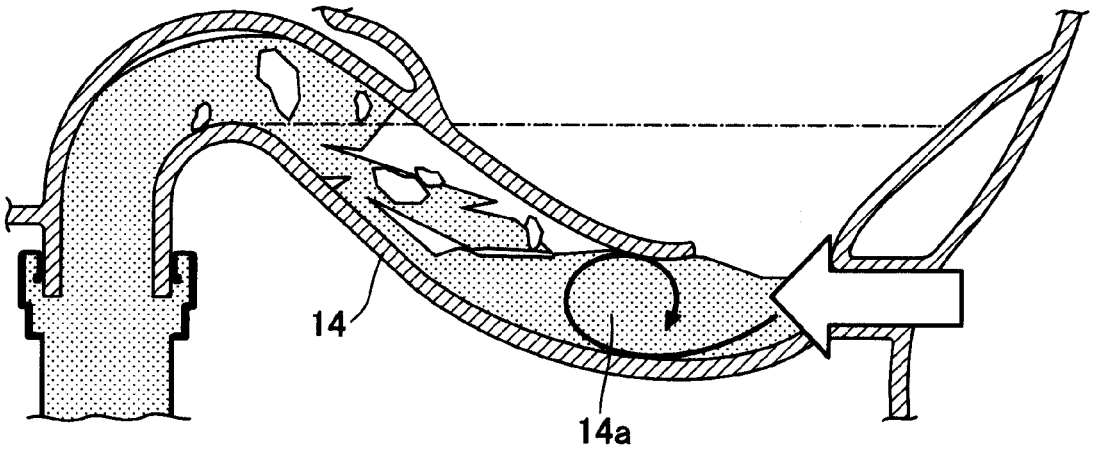
FIG. 6 is an enlarged view of FIG. 5(*e*).

Next, details of the siphon action and the push-out action in a flush toilet according to the present embodiment will be explained with reference to FIGS. 5 and 6. FIG. 5 explains the flushing mechanism when jet water spouting, which is to say the siphon action and the push-out action. FIG. 6 is an enlarged view of FIG. 5(*e*).

FIG. 5(*a*) shows the standby state (time t0-t1 in FIG. 4), this is the state whereby water is accumulated in the bowl portion. Next, after going through rim water spouting, jet water spouting is commenced as shown in FIG. 5(*b*) (time t2 in FIG. 4), at which point the pump rotates at an rpm of N1, and the drain trap pipe is filled with water by a large flow volume jet flow. Next, as shown in FIG. 5(*c*), air is drawn in from the drain trap pipe inlet portion, triggering the end of the siphon action (time t3-t4 in FIG. 4).

However, in the present embodiment, a large flow volume of jet water spouting continues to be supplied thereafter (t3-t4 in FIG. 4), so the volume of air drawn in from the drain trap pipe is small, as shown in FIG. 5(*d*). Moreover, even after air is drawn into the drain trap pipe, a large flow volume of jet spout water continues to be supplied (times t3-t4 in FIG. 4), therefore the jet spa water collides with the bottom wall surface of the drain trap pipe 14 inlet portion 14*a* as shown in FIG. 5(*e*) and FIG. 6, generating a swirling flow within the trap ascending pipe connecting port 14*b*. As a result of this swirling flow, the inlet portion 14*a* is sealed in section, and the inside of the inlet portion 14*a* and the trap ascending pipe 14*b* are essentially in a full state. This results in a continuation of the site connection. In other words, in the state depicted in FIG. 5(*e*) and FIG. 6 (time t3-t4 in FIG. 4), a push-out action is generated by the jet water spouting of a large flow volume supplied continuously while the previously occurring siphon action is maintained. Waste floating in the bowl portion is quickly discharged from the drain trap pipe by this push-out action.

Note that in the present embodiment, as shown in FIG. 6, a section of the drain trap pipe 14 inlet portion 14*a* is sealed, but the siphon action could also be maintained by sealing a section in any other part of the drain trap pipe 14 to essentially fill the drain trap pipe.

Thereafter, as shown in FIG. 5(*f*), the volume of flush water for jet spouting is gradually decreased (time t4-t5 in FIG. 4), thereby preventing the occurrence of a siphon cutoff sound, and the discharge of waste is quietly completed. Next, as shown in FIG. 5(*g*), rim water spouting (latter rim flushing) is started (time t5 in FIG. 4) following which, as shown in FIG. 5(*h*), the toilet returns to the original standby state (after time t6 in FIG. 4).

As explained above, in the first embodiment of the present invention the jet water spouting port 16 is disposed approximately horizontally, pointing toward the inlet portion of the drain trap pipe 14. When jet water spouting, the pressurizing pump 34 is first rotated at an rpm N1 to supply a large flow volume of jet spouted water to a drain trap pipe, thereby rapidly inducing a siphon effect (action), by which accumulated water and waste in the bowl portion 12 is quickly discharged. Next, the pressurizing pump 34 is rotated at an rpm N2 to continue supplying a large volume of jet spout water, at this point the jet spout water collides with the lower wall surface of the drain trap pipe 14 inlet portion 14*a* and a swirl current is generated within the trap ascending pipe connecting port 14*b* so that the interior of the inlet portion 14*a* and the trap ascending pipe connecting port 14*b* becomes essentially full of water, such that a section in one of those parts is sealed (push-out action). By thus rotating the pressurizing pump 34 at an rpm of N2 to continue to supply a large flow volume of jet spout water (push-out action) the siphon effect (action) can be maintained, and by this push-out action waste floating in the bowl portion can be quickly discharged from the drain trap pipe 14.

As result, according to the first embodiment of the present invention jet water spouting is performed using the pressurizing pump 34, therefore susceptibility to the effects of water main pressure is low, and by jet water spouting a large flow volume (the flow volume using the pressurizing pump at the N1 and N2 rpms), the volume of jet spouted flush water is reduced, the requirement for water conservation is met, and the siphon effect is maintained by the push-out effect, so that at the point when accumulated water in the bowl portion 12 is discharged by the initial siphon action, the siphon cutoff sound at the end of the siphon effect generated by the drawing in of a large volume of air from the drain trap pipe 14 inlet portion 14*a* can be eliminated, and because the siphon action is weaker due to the push-out effect than at the initial siphon, only a weak siphon cutoff sound is generated at the end of this week siphoning, therefore the siphon cutoff sound can be reduced.

Figure 7:
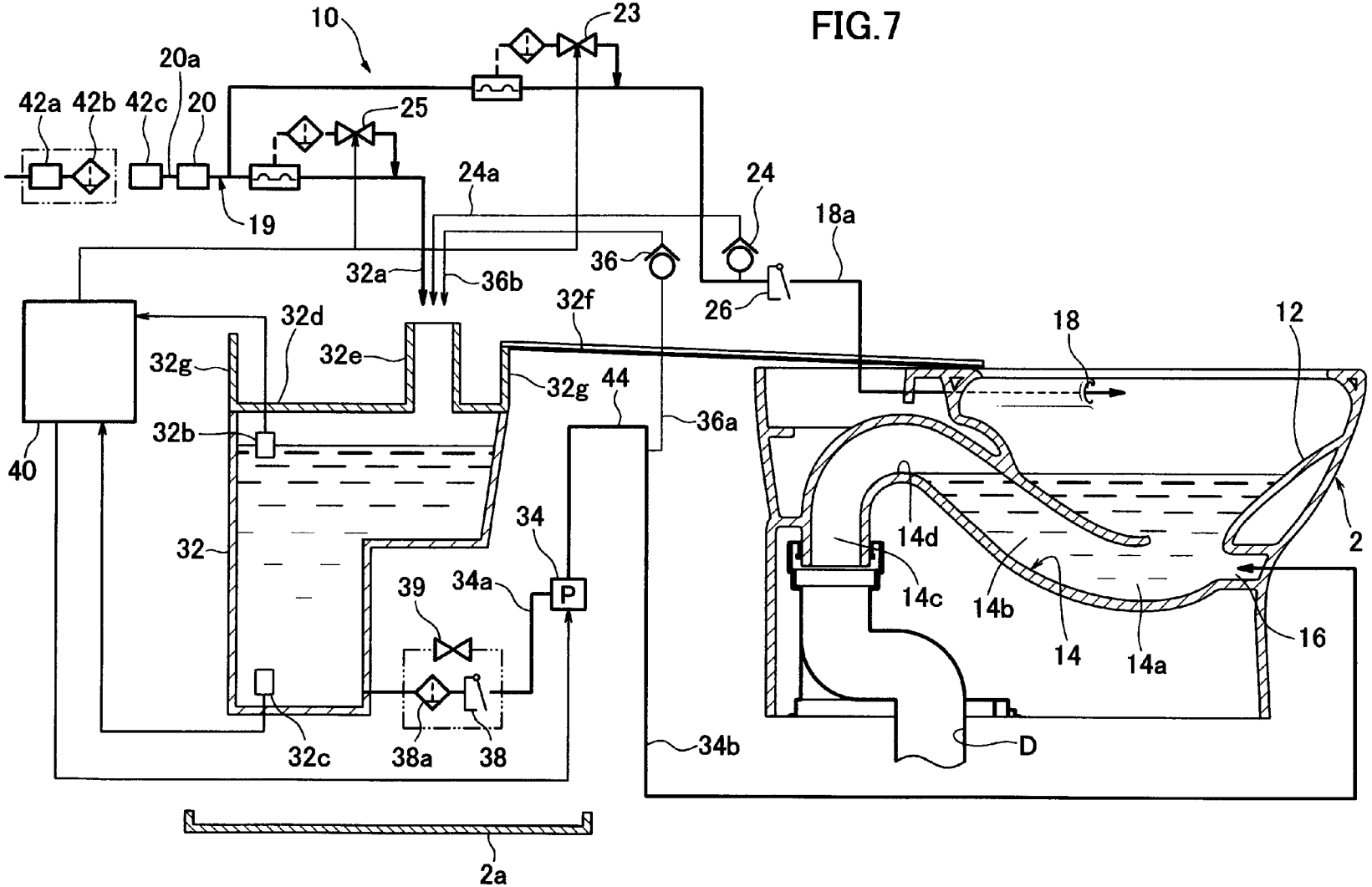
FIG. 7 is a schematic overview showing a flush toilet according to a second embodiment of the present invention.

Next, referring to FIG. 7, a flush toilet based on a second embodiment of the present invention will be described. Only the portions of the second embodiment differing from the first embodiment will be explained. As shown in FIG. 7, in this second embodiment, a rim water spouting electromagnetic valve 23 and a electromagnetic valve 25 are provided in place of the electromagnetic valve 22 and the switching valve 28 of the first embodiment. Specifically, the rim water spouting electromagnetic valve 23 is provided on the downstream side of the constant volume valve 20, and is connected to the rim-side water supply path 18*a*. The tank water supply electromagnetic valve 25 is provided on the downstream side of the constant volume valve 20, and is connected to the tank-side water supply path 32*a*.

Opening and dosing (turning ON and OFF) of the rim water spouting electromagnetic valve 23 and the tank water supply electromagnetic valve 25 is accomplished using a control signal from the controller 40.

In the flush toilet according to the second embodiment, the rim water spouting electromagnetic valve 23 and the tank water supply electromagnetic valve 25 can be independently opened and dosed, therefore as discussed below, rim water spouting and tank water supply can be carried out at the same timing.

Next, referring to FIG. 8, examples of timing for applicable rim water spouting (former rim flush and latter rim flush), jet water spouting (jet flush), and tank water supply in the first and second embodiments of the present invention will be explained (Ex. 1 through Ex. 5).

FIG. 8 shows the following examples, respectively: Ex. 1 in FIG. 8(*a*), Ex. 2 in FIG. 8(*b*), Ex. 3 in FIG. 8(*c*), Ex. 4 in FIG. 8(*d*), Ex. 5 in FIG. 8(*e*).

First, Ex. 1 in FIG. 8(*a*) is the same as what is shown in FIG. 4. In Ex. 1, former rim flushing is first performed for eight seconds, jet flushing is then performed for 2.9 seconds while supplying water to the tank is simultaneously performed for 2.9 seconds. Rim flushing is then performed for 5.5 seconds. Finally, water is supplied to the tank for 13.1 seconds.

In Ex. 1, supplying of chase water to the tank is carried out while the pressurizing pump is operating, thereby permitting the flow volume of jet spout water to be maximized. Also, because the latter rim flush and the supply of water to the tank are carried out independently, flush water in the latter rim flush goes around the bowl portion and can thereby increase the flushing effect.

Next, in Ex. 2 in FIG. 8(*b*), the former rim flush is first carried out for 8 seconds continuously, then the latter rim flush is carried out for 5.5 seconds. A jet flush is carried out for 2.9 seconds, and water is simultaneously supplied to the tank for 2.9 seconds prior to the end of the former rim flush. Thereafter, following the latter rim flush, water is supplied to the tank for 13.1 seconds. In this Ex. 2 the latter rim flush is carried out in continuation following the former rim flush, thereby facilitating easy control of the rim flush. Also, because the chase water is supplied to the tank while the pressurizing pump is operating, the flow volume of jet spout water can be maximized.

Next, in Ex. 3 of FIG. 8(*c*), a latter rim flush is carried out for 24 seconds in continuation after a former rim flush is carried out for 8 seconds. Also, jet flushing is performed for 2.9 seconds prior to the end of the former rim flush. Thereafter, following the commencement of the latter rim flush, water is supplied to the tank for 21 seconds, and the latter rim flush and supplying of water to the tank end simultaneously.

In Ex. 3 the latter rim flush and the supplying of water to the tank end simultaneously, therefore the user can be made aware that the tank is being supplied with water while the bowl portion is being refilled with flush water.

Next, in Ex. 4 of FIG. 8(*d*), a former rim flush is carried out for 8 seconds, a jet flush is then carried out for 2.9 seconds, and a latter rim flush is then carried out for 24 seconds. Supplying of water to the tank, on the other hand, starts simultaneously with the jet flush and is performed for 21 seconds, ending before the latter rim flush.

In Ex. 4, higher priority is given to supplying tank water than to the latter rim flush, therefore the tank can be reliably supplied with water.

Next, in Ex. 5 of FIG. 8(*e*), a latter rim flush is carried out for 24 seconds in continuation after a former rim flush is carried out for 8 seconds. Also, jet flushing is performed for 2 seconds prior to the end of the former rim flush. Thereafter, the tank is immediately supplied with water for 21 seconds.

In Ex. 5, the latter rim flush is carried out in continuation following the former rim flush, therefore rim flushing can be easily controlled. Since higher priority is given to supplying tank water than to the latter rim flush, the tank can be reliably supplied with water.

Figure 9:
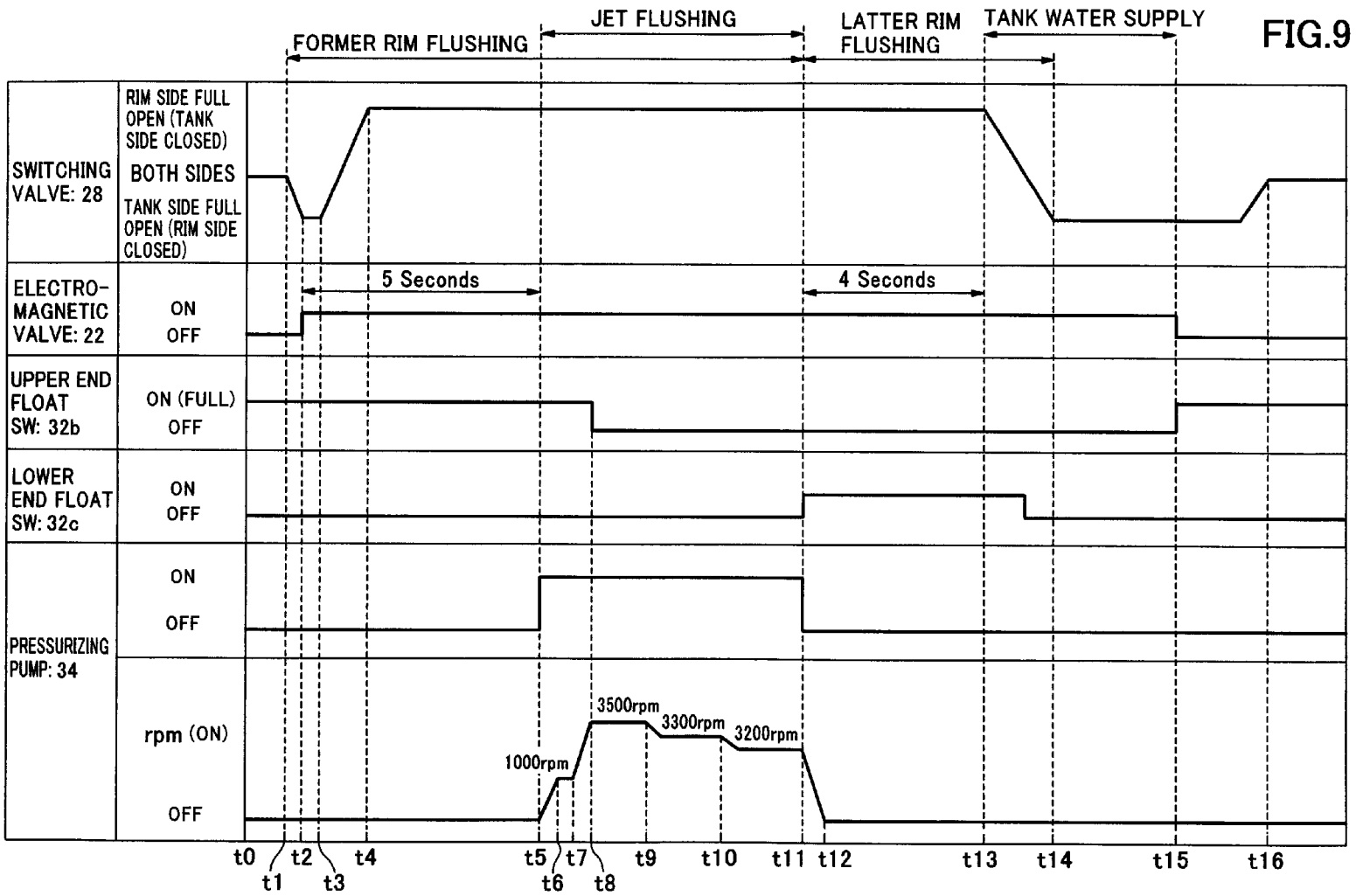
FIG. 9 is a timing chart showing the basic operation of a flush toilet according to a third embodiment of the present invention.
Figure 10:
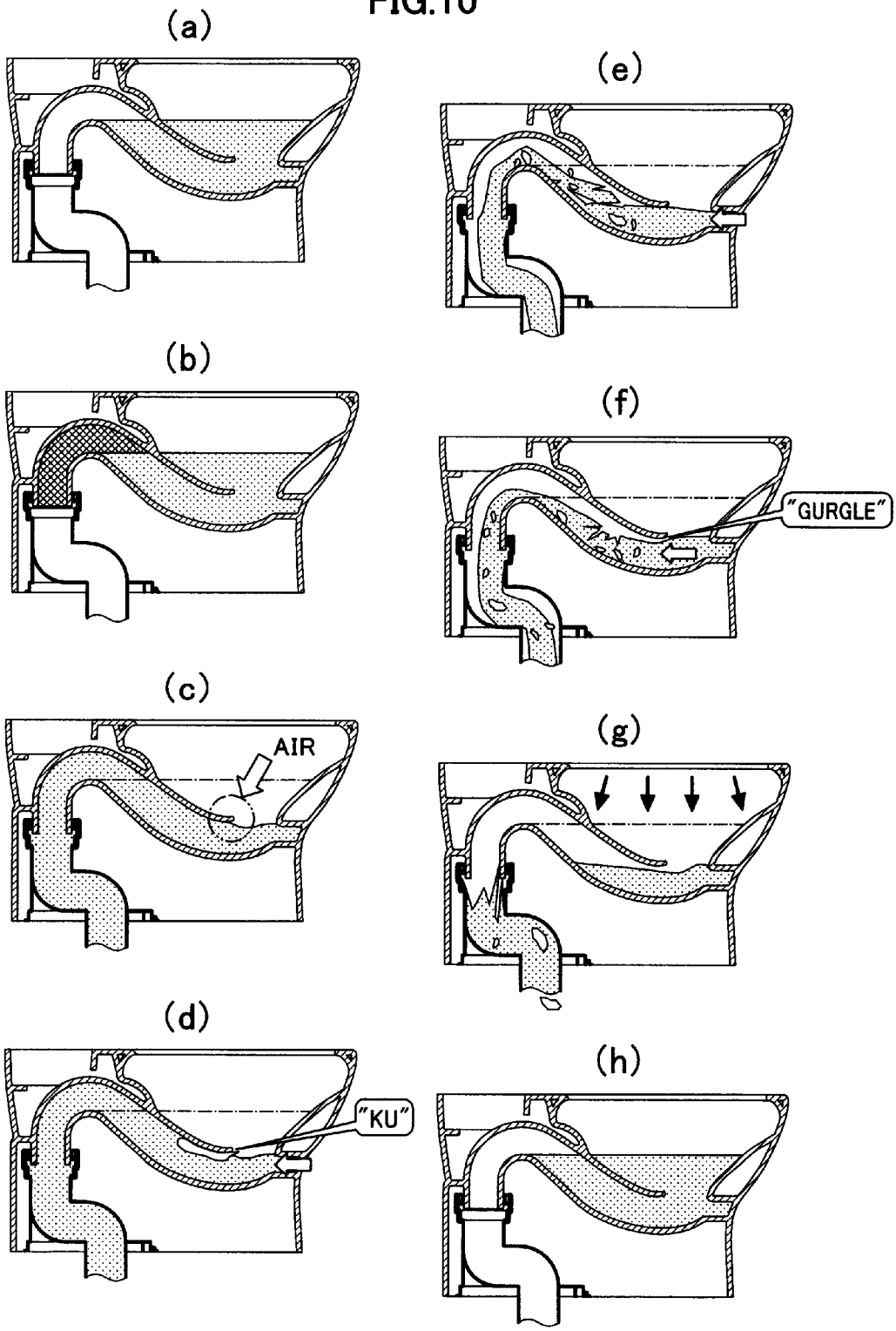
FIG. 10 is a view explaining the siphon action and push-out action of a flush toilet according to a third embodiment of the present invention.
Figure 11:
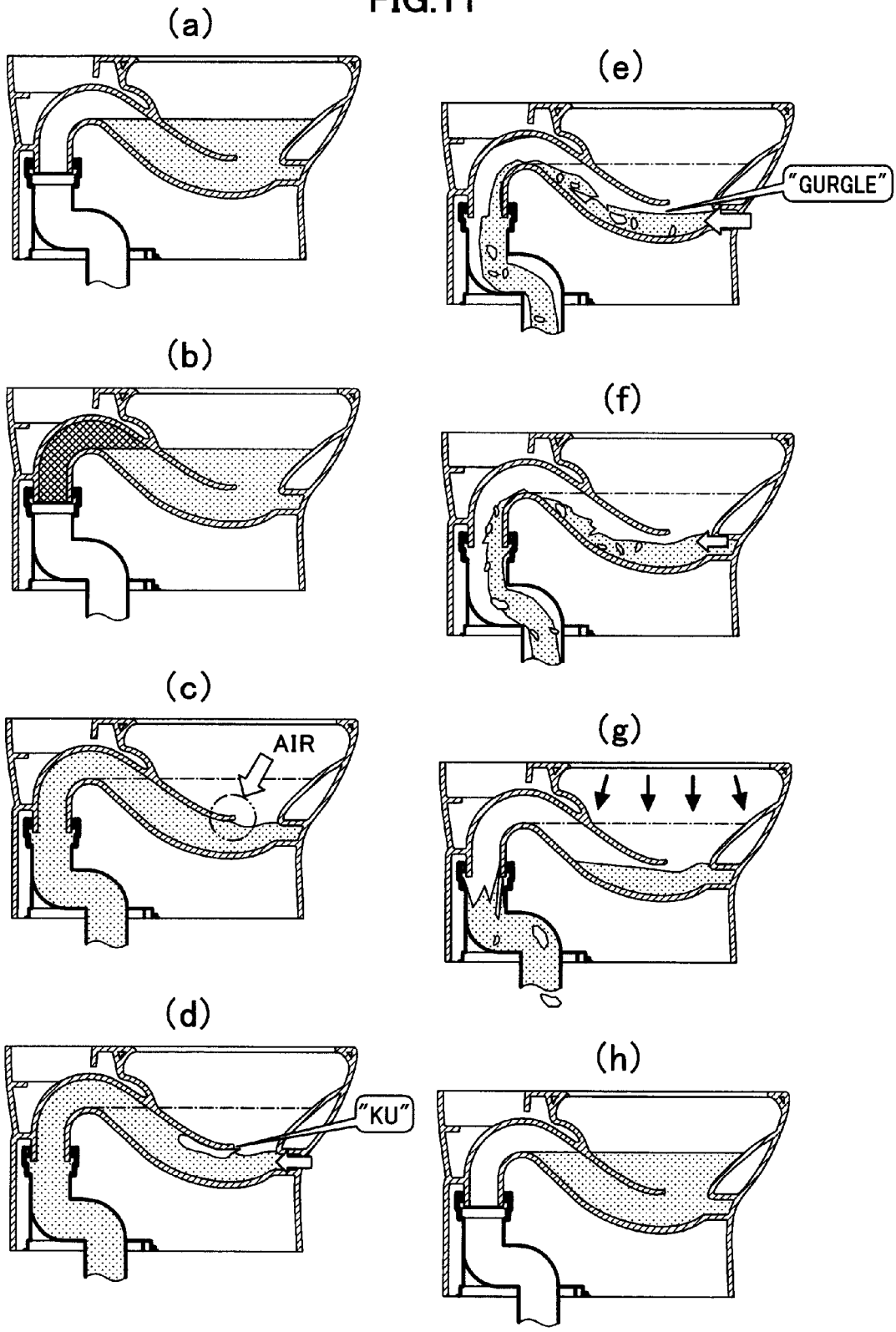
FIG. 11 is a view explaining the siphon action and push-out action of a flush toilet according to a third embodiment of the present invention.

Next, a flush toilet according to a third embodiment of the present invention will be described, referring to FIGS. 9 through 11. FIG. 9 is a timing chart showing the basic operation of a flush toilet according to a third embodiment of the present invention; FIGS. 10 and 11 are views explaining the siphon action in the jet of water spouting state in a flush toilet according to a third embodiment of the present invention.

The structure of the flush toilet in this third embodiment is the same as that of the flush toilet shown in FIGS. 3 and 7, so for convenience, basic operation of the flush toilet having a structure shown in FIG. 3 will be explained using FIG. 9.

As shown in FIG. 9, in the standby state (time to-t1) the switching valve 28 is first in a neutral position communicating with both the rim-side water supply path 18*a* and the tank-side water supply path 32*a*. Next, when a toilet flushing switch (not shown) is operated (time t1) in this standby state (time t0-t1), former rim water spouting is commenced (time t1-t11). At this point the switching valve 28 is first placed in a state whereby it is fully open to the tank-side water supply path 32*a* during the time t2-t3 (the tank side fully open position). Simultaneously (time t2), the electromagnetic valve 22 is turned ON and flush water is caused to flow into the water supply path 19. This enables air remaining within the water supply path 19 on the upstream side of the switching valve 28 to be discharged into the reservoir tank 32. As a result, the air discharge sound from the rim water spouting port 18 arising when the switching valve 28 is suddenly switched to the rim-side water supply path 18*a*, which is the rim side, can be prevented.

Next, between times t3-t4 the switching valve 28 is switched from the tank-side fully open position to the rim-side fully open position, flush water is supplied to the rim water spouting port 18, and flush water is spouted from the rim water spouting port 18.

Next, after a predetermined time (e.g. 5 seconds) has elapsed from time t2, jet water is spouted in the interval between times t5-t11 by turning ON the pressurizing pump 34 and using the pressurizing pump 34 to supply flush water in the reservoir tank 32 to the jet water spouting port 16, thereby spouting flush water from the jet water spouting port 16.

Here, at time t5, when jet water spouting is commenced by the pressurizing pump 34, rim spouting is carried out continuously. Moreover, this rim spouting continues without interruption from the beginning until the end of the jet water spouting.

In the present embodiment, rim water spouting is being carried out continuously when jet water spouting is started, i.e., jet water spouting is carried out with an elevated level of accumulated water in the bowl portion 12 and the drain trap pipe 14 due to rim water spouting, therefore a siphon effect can be induced in a short period of time, and a strong siphon effect can be generated. As a result, the volume of jet water spouting flush water for starting the siphon action can be reduced, thus achieving water conservation.

Furthermore, in the present invention rim water spouting is continued without interruption from the start until the end of jet water spouting (times t5-t11), making it difficult for air to flow into the inlet portion of the drain trap pipe, and thus suppressing the siphon cutoff sound.

Next, the controller 40 controls the rpm of the pressurizing pump 34 as follows while this jet spouting is going on.

First, at time t6-t7, the pressurizing pump 34 is kept at a relatively slow speed (e.g., 1000 rpm), by which means air remaining in the vicinity of the flush water pipe 34*b* peak portion 44 (i.e., the portion positioned above the accumulated water surface of the bowl portion 12) is discharged from the jet water spouting port 16. As a result, the sound of air being discharged from the jet water spouting port 16, which is generated when the pressurizing pump 34 is suddenly started at its originally intended high rotation speed, can be prevented.

Next, at time t8-t9, the pressurizing pump 34 is rotated at a high speed (e.g., 3500 rpm). This causes the pressurizing force of the pressurizing pump 34 to increase, so that a large flow volume of flush water is spouted from the jet water spouting port 16. At this point, rim water is being continuously spouted from the rim water spouting port 18, therefore the flow volume of flush water spouted from the rim water spouting port 18 is added thereto, and a large flow volume of flush water flows into the drain trap pipe 14 inlet portion 14*a*, such that a siphon effect is rapidly induced, and accumulated water and waste in the bowl portion 12 is quickly discharged. At this point the flow volume flowing into the drain trap pipe 14 inlet portion 14*a* is less than a total of 75 liters/minute-120 liters/minute for the flow volume coming from the rim water spouting (10 liters/minute-15 liters/minute) and from the jet spout water (the first flow volume), which is a large flow volume compared to conventional examples.

Next, at time t9-t11, the flow volume of flush water flowing into the drain trap pipe 14 inlet portion 14*a* (the second flow volume) is set to be a smaller flow volume than the flow volume above (the first flow volume), therefore the pressurizing pump 34 rpm is slightly decreased. In this FIG. 9 example, the rpm of the pressurizing pump 34 is reduced in two stages (e.g., 3300 rpm and 3200 rpm) in order to cause the second flow volume to flow into the drain trap pipe 14 inlet portion 14*a*. At this point the pressurizing pump 34 rpm may have just one stage, without variation, or may be reduced in three or more stages.

Thus, in the present embodiment, a second flow volume of flush water, smaller than the first flow volume, is caused to flow into the drain trap pipe 14 inlet portion 14*a* immediately before the siphon effect generated by the first flow volume ends (time t9).

In the third embodiment, the second flow volume is at least sufficient to generate a flow speed such that waste in the bowl portion 12 can be conveyed to pass over the drain trap pipe 14 peak portion 14*d*, the flow volume can be adjusted within the range over which waste can be conveyed from the bowl portion 12. By making the second flow volume smaller than first flow volume, waste floating in the bowl portion 12 can be discharged with a small flow volume, thereby conserving water and reducing noise by lowering the sound of water spouting from the jet water spouting port 16. Moreover, the inertial force of the pressurizing pump 34 is reduced by lowering the rpm of the pressurizing pump 34, reducing the pressurizing pump 34 inertial force means that a smaller amount of flush water is sufficient to be drawn in from the reservoir tank 32, so that even though the size of the reservoir tank 32 is made smaller, sucking in of air by the pressurizing pump 34 in what is known "air cavitation" can be prevented.

Adjusting the second flow volume to various values enables the execution of a first pattern, a second pattern, and/or a third pattern.

That is, the first pattern is the same as the state shown in FIG. 5(*e*) and FIG. 6 in the first embodiment described above, wherein the siphon action can be continued by arranging for the flow volume of flush water flowing into the drain trap pipe 14 (the second flow volume) to generate a flow speed capable of conveying waste and of sealing a section in some part of the drain trap pipe 14, essentially filling the drain trap pipe 14 with water. At this point, the pressurizing pump 34 rpm for generating the second flow volume in time t9-t11 is the first stage 3300 rpm (time t9-t11). Note that as shown in FIG. 9, at time t9-t11, the second stage 3300 rpm (time t9-t10) (corresponding to the first pattern state) and 3200 (time t9-t10) (corresponding to the second pattern described below) may also be used.

Next, as shown in FIG. 10(*e*) described below, the flow volume of flush water flowing into the drain trap pipe 14 (the second flow volume) generates a flow speed capable of conveying waste and of sealing a section in some part of the drain trap pipe 14 in which the siphon action has ceased. At this point, the pressurizing pump 34 rpm for generating the second flow volume in time t9-t11 is at the first stage 2800 rpm (time t9-t11). Note that as shown in FIG. 9, in time t9-t11, the second stage 2800 rpm (time t9-t10) (corresponding to the second pattern state) and 2600 (time t9-t10) (corresponding to the third pattern described below) may also be used.

Note that at time t8-t9 in FIG. 9, the rpm of the pressurizing pump 34 for generating the first flow volume to induce a siphon effect may also be lowered to 2800 rpm, for example, thus reducing the volume of flush water use. In this case the flow volume (second pattern) would be of the order necessary to seal a section of some part of the drain trap pipe 14 after time t9, but since water is accumulated in the old portion 12, a siphon effect can be induced even at this low rpm. However the siphon suction force on waste is weak, so this is preferably used for flushing after small-flush use.

In the third pattern, moreover, the state shown in FIG. 11(*e*) and described below is achieved, whereby the flow volume of flush water flowing in the drain trap pipe 14 (the second flow volume) generates a flow speed capable of conveying waste without sealing a section of the drain trap pipe 14. At this point the pressurizing pump 34 rpm for generating a second flow volume at time t9-t11 in FIG. 9 is the first stage 2600 rpm (time t9-t11).

Next, at time t11, when the level of flush water in the reservoir tank 32 drops and the bottom end float switch 32*c* turns ON, operation of the pressurizing pump 34 stops. At this point the pressurizing pump 34 rpm is slowly reduced during the interval between t11 and t12 so that the spouting of water from the jet water spouting port 16 is gradually reduced. This enables the prevention of a siphon cutoff sound arising when there is a sudden interruption in the siphon action (especially in the first pattern).

At time t11 jet water spouting has ended, but at this point rim water spouting continues as it was, and during a predetermined period from time t11 to time t13 (e.g. 4 seconds), only rim water spouting (latter rim water spouting) is continued.

Subsequently, at time t13-t14, the switching valve 28 is switched from rim-side fully open to tank-side fully open. Flush water is thus stored in the reservoir tank 32.

Next, at time t15, the top end float switch 32*b* turns ON due to the rise in water level in the reservoir tank 32, which turns OFF the electromagnetic valve 22 (a dosing operation) such that the inflow of flush water to the reservoir tank 32 is stopped.

Next, at time t16, the switching valve 28 returns to the neutral position at which it communicates with both the rim side and the tank side, and is restored to the standby state (the same state as at time t0).

Next, referring to FIG. 10, a second pattern will be explained, wherein the second flow volume described above is caused to flow into the drain trap pipe 14 inlet portion 14*a*.

In this second pattern, the pressurizing pump 34 rpm during time t9-t11 in FIG. 9 is reduced to less than that used in the first pattern, flush water is jet water spouted from the jet water spouting port 16; the rim water spouting flow volume is added thereto, and a second flow volume is caused to flow into the drain trap pipe 14 inlet portion 14*a*.

Among the states shown in FIGS. 10(*a*)-(*h*) for this second pattern, only the states shown in FIGS. 10(*e*) and (*f*) differ from the states shown in FIGS. 5(*e*) and (*f*) for the first pattern, others are the same.

That is, in the second pattern, during time t9-t10 shown in FIG. 9, a relatively large volume of flush water is continuously expelled from the jet water spouting port 16 even when air is drawn into the drain trap pipe 14, therefore this jet water spouting seals a section of the drain trap pipe 14 inlet portion 14*a*. Note that in the second pattern there is a slight decrease in the flow volume supply compared to the first pattern, therefore air penetrates into the drain trap pipe 14 from the drain pipe D side, at which point the siphon action ends.

Thus, in the second pattern, some portion of the drain trap pipe 14 (the inlet portion 14*a* or the like) is sealed, so there is no drawing in of large volumes of air in clumps from the drain trap pipe 14 inlet portion 14*a*, as a result of which the siphon cutoff sound at the time the siphon action ends, which is generated by the drawing in of large volumes of air from the drain trap pipe 14 inlet portion 14*a* upon the discharge of accumulated water in the bowl portion 12 by siphon action, can be suppressed, and the return of foul smells from the drain pipe D can also be prevented. In addition, the jet water spouting of a relatively large flow volume from the jet water spouting port 16 enables flush water to pass over the drain trap pipe 14 peak portion 14*d*, as a result of which waste floating in the bowl portion can be discharged from the drain trap pipe 14.

Next, referring to FIG. 11, a third pattern will be explained, wherein the above-described second flow volume is caused to flow into the drain trap pipe 14 inlet portion 14*a*.

In this third pattern, the rpm of the pressurizing pump 34 during time t9-t11 is further reduced below that of the second pattern, flush water is jet spouted from the jet water spouting port 16, a flow volume caused by rim water spouting is added thereto, and the second flow volume is caused to flow into the drain trap pipe 14 inlet portion 14*a*.

Among the states shown in FIGS. 11(*a*)-(*h*) for this second pattern, only the states shown in FIGS. 11(*e*) and (*f*) differ from the states shown in FIGS. 5(*e*) and (*f*) for the first pattern, others are the same.

That is, as shown in FIG. 11(*d*), at time t9-t10 in FIG. 9 air is drawn into the drain trap pipe and siphon action ends, but a relatively large flow volume of flush water is still being spouted from the jet water spouting port 16, so the flow of that flush water allows the opening surface area of the drain trap pipe 14 inlet portion 14*a* to be reduced such that there is not a large volume of air drawn in from that point, as a result of which the siphon cutoff sound at the time the siphon action ends, which is generated by the drawing in of large volumes of air from the drain trap pipe 14 inlet portion 14*a* upon the discharge of accumulated water in the bowl portion 12 by siphon action, can be suppressed, and the return of foul smells from the drain pipe D can also be prevented. Moreover, flush water can pass over the drain trap pipe 14 peak portion 14*d*, as a result of which waste floating in the bowl portion can be discharged from the drain trap pipe 14.

Figure 12:
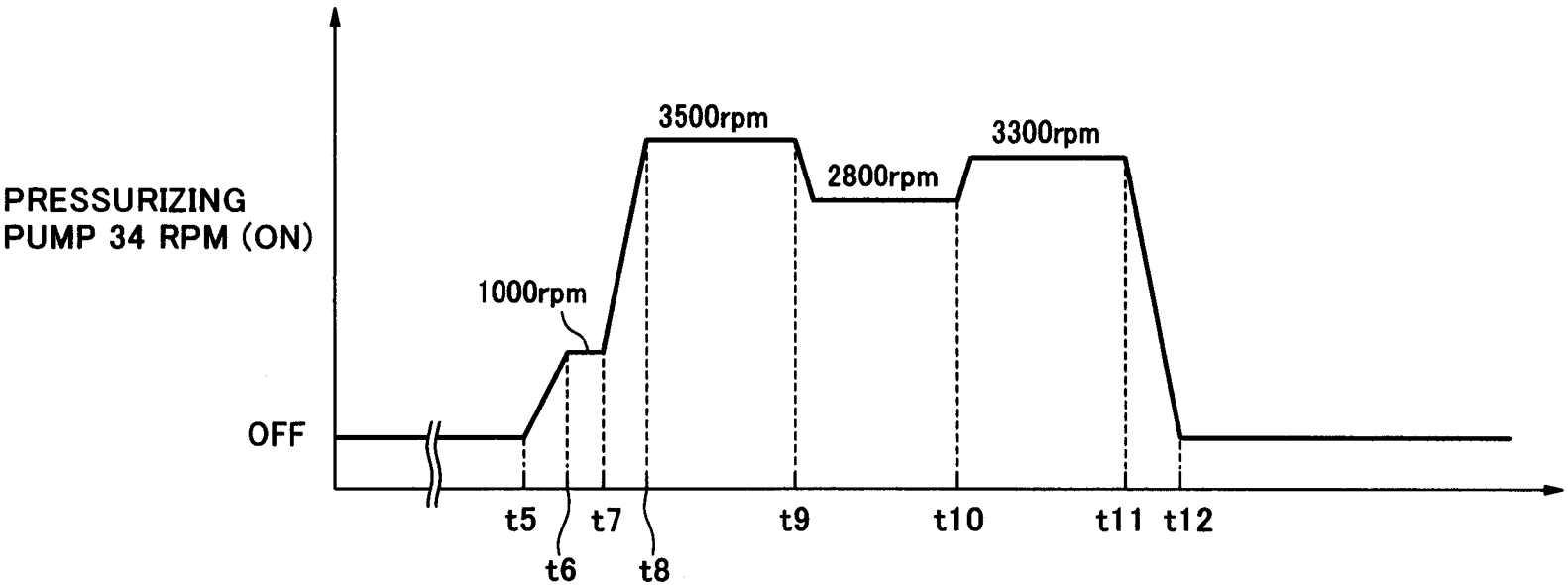
FIG. 12 is a timing chart showing the change in pressurizing pump rpm in a flush toilet according to a fourth embodiment of the present invention.

Next, referring to FIG. 12, a flush toilet according to a fourth embodiment of the present invention will be explained. FIG. 12 is a time chart showing changes in pressurizing pump rpm in a flush toilet according to the fourth embodiment of the present invention. In this fourth embodiment, pressurizing pump 34 rpm differs from that of the third embodiment described above with respect to only time t9-t11 in FIG. 9; other parts are the same as the third embodiment.

In this fourth embodiment, as shown in FIG. 12, the rpm of the pressurizing pump 34 is increased up to 3500 rpm at time t7, next, at time t9, the rpm of the pressurizing pump 34 is decreased from 3500 rpm to 2800 rpm (the jet water spouting state at time t9-t10 is the same as in the above described third pattern). By thus reducing rpm, the instantaneous water spouting volume can be decreased to conserve water. Next, at time t10, the rpm of the pressurizing pump 34 is increased to 3300 rpm (the jet water spouting state at time t10-t11 is the same as the above described first pattern). By thus creating a strong blow zone through the increase in jet water spouting volume, waste (especially waste floating in the accumulated water remaining after siphoning has been generated) can be discharged from the trap ascending pipe connecting port 14*b*, thereby increasing flushing power.

In the embodiment described above, the pressurizing pump used is one in which rpm is varied to adjust flow volume, but an accumulator tank in combination with a flow control valve, for example, could also be used as a pressurizing means other than this pressurizing pump. In this example the reservoir water tank comprises an accumulator tank, the flow volume of flush water supplied under pressure by that accumulator tank could be controlled by a proportional electromagnetic valve type of flow control valve to achieve spouting from a jet water spouting port.

Figure 13:
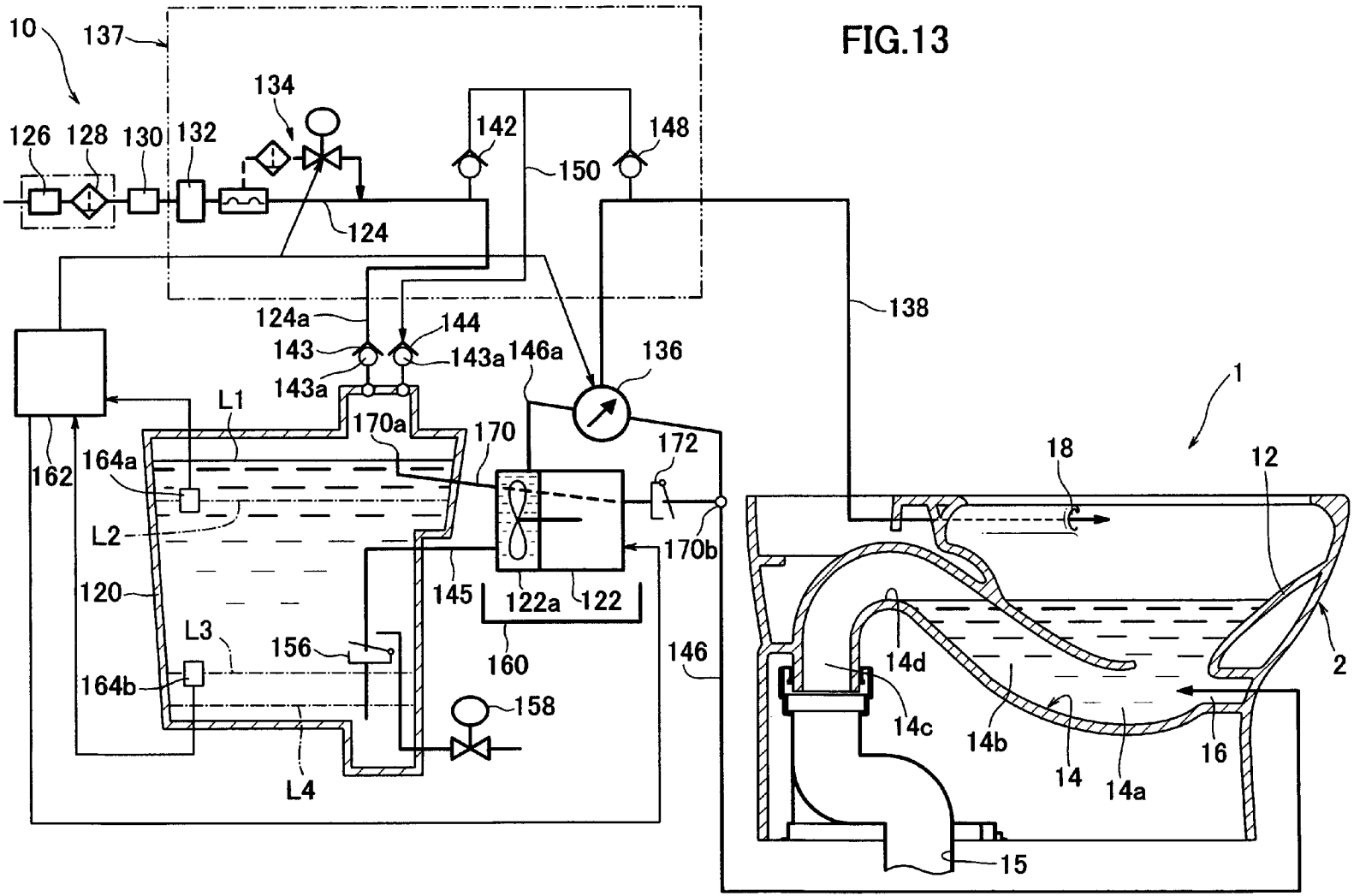
FIG. 13 is a schematic overview showing a flush toilet according to a fifth embodiment of the present invention.
Figure 14:
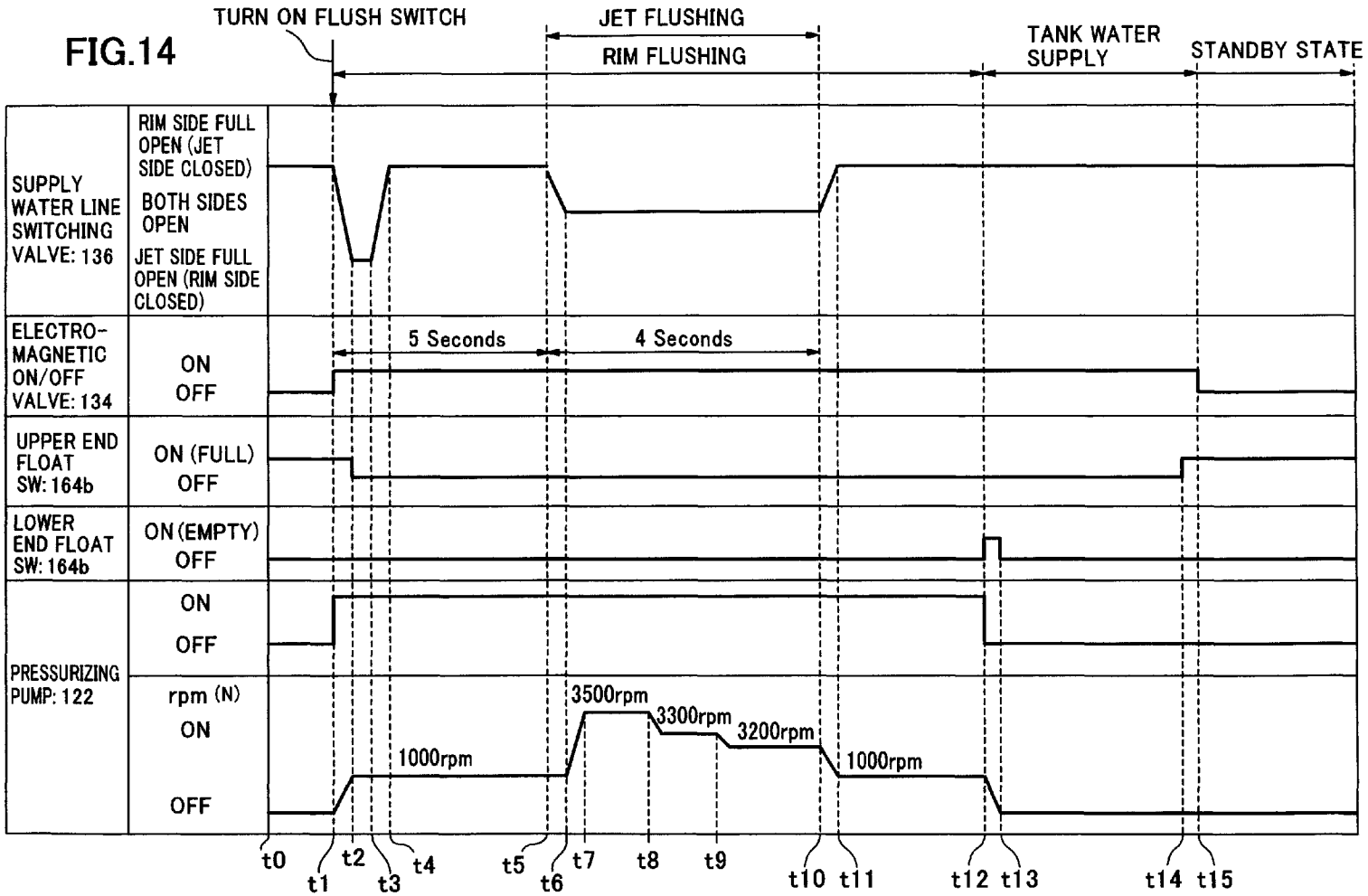
FIG. 14 is a timing chart showing the basic operation of a flush toilet according to a fifth embodiment of the present invention.

Next, referring to FIGS. 13 and 14, a flush toilet according to a fifth embodiment of the present invention will be explained. FIG. 13 is a schematic overview showing a flush toilet according to a fifth embodiment of the present invention, FIG. 14 is a timing chart showing the basic operation of a flush toilet according to a fifth embodiment of the present invention.

Note that the basic structure of the flush toilet in the fifth embodiment is the same as that shown in FIG. 1 and FIG. 3, therefore an explanation thereof is omitted.

Next, referring to FIG. 13, details of the functional portion 10 of the flush toilet 1 of the present embodiment will be explained.

As shown in FIG. 13, a supply path 124, over which flush water is supplied from a water main, is provided on the functional portion 10, and a stopcock 126, a strainer 128, a splitter hardware 130, a constant flow valve 132, and starting from the upstream side, a diaphragm type electromagnetic on/off valve 134 are respectively provided on a supply path 124.

As described below, the constant flow valve 132, the electromagnetic on/off valve 134, and the vacuum breakers 142, 148 described below are integrated into a single valve unit 137.

The supply path 124 downstream side 124*a* is connected to a reservoir tank 120, and supplies flush water to the reservoir tank 120.

Here the purpose of the constant flow valve 132 is to restrict flush water flowing in through the stopcock 126, the strainer 128, and the splitter hardware 130 to being less than a predetermined flow volume. Flush water which has passed through the constant flow valve 132 flows into the electromagnetic on/off valve 134, and flush water which has passed through the electromagnetic on/off valve 134 is supplied to the reservoir tank 120 by the supply path 124.

A pump-side supply path 145 is connected to the lower portion of the reservoir tank 120, and a pressurizing pump 122 provided with a pump chamber 122*a* is connected to the downstream end of this pump-side supply path 145. Furthermore, the pressurizing pump 122 and the jet water spouting port 16 are connected via the jet-side water supply path 146, and the pressurizing pump 122 pressurizes flush water stored in the reservoir tank 120 so that it is supplied up to the jet water spouting port 16.

The jet-side water supply path 146, as shown in FIG. 13, is formed with a convex upward-pointing shape, and the peak portion 146*a* of this convex portion is at the highest position.

A water supply line switching valve 136 is attached to this jet-side water supply path 146. In addition, a rim-side water supply path 138 for supplying flush water to the rim water spouting port 18 is provided on the water supply line switching valve 136 so as to branch off from the jet-side water supply path 146. This water supply line switching valve 136 can supply flush water to both the rim-side water supply path 138 and the jet-side water supply path 146 at the same timing, making the proportion of supplied water volume optionally variable to the rim side and the tank side.

Next, a rim water spouting vacuum breaker 148 is provided on the above-described rim-side water supply path 138, and enabling the prevention of flush water back flow from the rim water spouting port 18 when a negative pressure is generated on the upstream side of the water supply line switching valve 136. As shown in FIG. 13, the rim water spouting vacuum breaker 148 is disposed above the upper edge surface of the bowl portion 12, and thereby reliably prevents back flow. In addition, flush water overflowing from the atmosphere release portion on the rim water spouting vacuum breaker 148 passes through a return pipe 150 and flows into the reservoir tank 120.

A vacuum breaker 142 serving as a check valve is provided on the supply path 124 as well, and back flow from the reservoir tank 120 can thus be prevented.

Here, the reservoir tank 120 is a sealed reservoir tank, and a ball-type check valve 143 is provided on the connecting portion between the supply path 124 downstream side 124*a* and the reservoir tank 120. Because of this ball-type check valve 143, even if the [water level in the] reservoir tank 120 exceeds the position of the top end 170*a* on the overflow flow path 170, described below, and is in a full state, a ball 143*ax* floats and the connecting portion with the supply path 124 is dosed, so that back flow of flush water to the supply path 124 does not occur.

Similarly, a ball-type check valve 144 is also provided at the connecting portion of the return pipe 150 and the reservoir tank 120, so that even if the [water level in the] reservoir tank 120 exceeds the position of the top end 170*a* on the overflow flow path 170, described below, and is in a full state, there is no back flow of flush water to the return pipe 150.

In addition, a jet water spouting flapper valve 156 serving as a check valve and a drain plug 158 are provided on the pump-side supply path 145. This jet water spouting flapper valve 156 and drain plug 158 are positioned at a height in the vicinity of the bottom edge portion of the reservoir tank 120 beneath the pressurizing pump 122. Therefore by releasing the drain plug 158, flush water in the reservoir tank 120 and in the pressurizing pump 122 can be drained for maintenance and the like. By disposing the jet water spouting flapper valve 156 between the reservoir tank 120 and the pressurizing pump 122, flush water will flow in reverse from the pressurizing pump 122 to the reservoir tank 120 when the water level in the reservoir tank 120 drops below the height of the pressurizing pump 122, thereby preventing freewheeling of the pressurizing pump 122 due to an absence of flush water in the pressurizing pump 122. A water receiving tray 160 is disposed under the pressurizing pump 122 so as to receive condensed water droplets or leaks.

A controller 162 is built into the functional portion 10 for controlling the opening/dosing operation of the electromagnetic on/off valve 134, the switching operation of the supply water path switching valve 136, and the rpm and operation time, etc. of the pressurizing pump 122.

An upper end float switch 164*a* and a lower end float switch 164*b* are disposed inside the reservoir tank 120.

The upper end float switch 164*a* turns ON when the water level in the reservoir tank 120 reaches a predetermined position L2 slightly lower than the normal use maximum water level L1, this is sensed by the controller 162, which closes the electromagnetic on/off valve 134.

The lower end float switch 164*b* turns ON when the water level in the reservoir tank 120 reaches a predetermined position L3 slightly higher than the normal use minimum water level L4; this is sensed by the controller 162, which stops the pressurizing pump 122.

An overflow flow path 170 is further provided, and the upper end 170*a* of the overflow flow path 170 is opened into the reservoir tank 120, whereas the lower end 170*b* thereof is connected to the jet-side water supply path 146.

A flapper valve 172 serving as a check valve is attached to the overflow flow path 170. This overflow flow path 170 and flapper valve 172 prevent back flow from the jet water spouting port 16 and form a partition therebetween.

The controller 162 sequentially activates the electromagnetic on/off valve 134, the pressurizing pump 122, and the supply water path switching valve 136 in response to a user turning ON a flush switch (not shown), thereby first spouting water from the rim water spouting port 18 and then, while continuing to spout water from the rim, starting the spouting of water from the jet water spouting port 16 so as to flush the bowl portion 12. Furthermore, the controller 162 continues to release the electromagnetic on/off valve 134 after flushing has ended, thereby replenishing flush water to the reservoir tank 120. When the water level inside the reservoir tank 120 rises and the top end float switch 164*a* detects a predetermined stored water volume, controller 162 doses the electromagnetic on/off valve 134 and stops the supply of water.

Next, referring to FIG. 14, the basic operation of a fifth embodiment flush toilet will be described.

As shown in FIG. 14, the supply water path switching valve 136 in the standby state (time t0-t1) is first at a rim-side fully open position (the 100% rim side/0% jet side position), communicating only with the rim-side water supply path 138. Next, when the toilet flush switch (not shown) is turned to ON (time t1) in this standby state (time t0-t1), the electromagnetic on/off valve 134 is turned to open (ON), and flush water is supplied to the reservoir tank 120, while at the same time the pressurizing pump 122 is started (turned ON) and the rpm is raised to a low speed of 1000 rpm. Simultaneously the supply water path switching valve 136 is switched from the rim-side fully open position up to the jet-side fully open position (the 0% rim side/100% jet side position).

Next, at time t2-t3 the supply water path switching valve 136 is held in the jet-side fully open position, and thereafter at time t3-t4 the supply water path switching valve 136 is gradually switched from the jet-side fully open position to the rim-side fully open position, and flush water is spouted from the rim water spouting port 18.

Having once switched the supply water path switching valve 136 from the rim-side fully open position to the jet-side fully open position and thereafter to the rim fully open position, air remaining in the pump-side supply path 145 can be discharged from the jet water spouting port 16. As a result, a discharge sound in the rim water spouting port 18, arising when air in the pump-side supply path 145 is suddenly discharged from the rim side, can be prevented.

Rim flushing is thus carried out during the interval (e.g. 5 seconds) from time t1 until time t5. Next, during the interval from time t5-t6, the supply water path switching valve 136 is gradually switched from the rim-side fully open position to the both sides open position, communicating with both the rim side and the jet side. After this, at time t6, the pressurizing pump 122 is rotated at high speed (e.g. 3500 rpm), and jet water spouting is commenced.

Here, at time t6, rim water spouting is continued when jet water spouting is commenced by the pressurizing pump 122. Furthermore, rim water spouting is continued without interruption from the start until the end of jet water spouting (between time t5-t10).

In the present embodiment, when jet water spouting commences, rim water spouting is being carried out continuously; in other words, jet water spouting is carried out in a state whereby the accumulated water level in the bowl portion 12 in the drain trap pipe 14 is rising due to rim water spouting, such that a siphon action can be induced in a short time period, and a strong siphon action and be generated. As a result, the volume of jet spouting flush water needed to start the siphon action can be reduced and water conservation can be achieved.

In the present embodiment, rim water spouting is continued without interruption from the start until the end of jet water spouting (between time t6-t10), making it difficult for air to flow into the inlet portion of the drain trap pipe, thus enabling the suppression of the siphon cutoff sound. Adhesion of the floating waste to the surface of the bowl can be prevented, and floating waste can be reliably discharged by jet spouting water while gathering floating waste at the center of the accumulated water.

Next, the pressurizing pump 122 rpm is controlled by the controller 162 as follows during this jet water spouting.

First, at time t5-t6, prior to jet water spouting, the water supply line switching valve 136 switches from the rim-side fully open position to the both sides open position, at which point the pressurizing pump 122 is held at a relatively low speed (e.g. 1000 rpm). By this means the air remaining in the vicinity of the jet-side water supply path 146 peak portion 146*a* (i.e. the portion located above the surface of the accumulated water in the bowl portion 12) is slowly discharged from the jet water spouting port 16. As a result, an air discharge sound from the jet water spouting port 16, which arises when the pressurizing pump 122 is suddenly started up at full high-speed rotation, can be prevented.

Next, at time t7-t8, the pressurizing pump 122 is run at high-speed rotation (e.g. 3500 rpm). This increases the pressurizing force from the pressurizing pump 122, such that a large volume of flush water is spouted from the jet water spouting port 16. At this point rim water is being continuously spouted from the rim water spouting port 18, therefore the flow volume of flush water spouted from the rim water spouting port 18 is added thereto, and a large volume of flush water flows into the drain trap pipe 14 inlet portion 14*a*, such that a siphon effect is rapidly induced, and accumulated water and waste are quickly discharged from the bowl portion 12. At this point the flow volume (first flow volume) flowing into the drain trap pipe 14 inlet portion 14*a* is a large flow volume compared to the past, at a total of 75 liters/minute-120 liters/minute as the flow volumes from rim water spouting and jet water spouting.

Next, at time t8-t9, the volume of flush water (the second flow volume) flowing into the drain trap pipe 14 inlet portion 14*a* is less than the flow volume described above (the first flow volume), therefore the rpm of the pressurizing pump 112 is made slightly lower. In the FIG. 14 example, the rpm of the pressurizing pump 122 is made to decrease to a second stage (e.g. 3300 rpm and 3200 rpm). At this point the rpm of the pressurizing pump 122 may also be a single stage without variation, or may be reduced in three or more stages.

Thus in the present embodiment a second flow volume of flush water, less than a first flow volume, is caused to flow into the drain trap pipe 14 inlet portion 14*a* immediately before the end of the siphon effect generated by the first flow volume (time t8).

In the fifth embodiment as well, the second embodiment flow volume is the flow volume needed to generate at least a flow speed such that waste in the bowl portion 12 can pass over the drain trap pipe 14 peak portion 14*d* and be conveyed. As in the above described third embodiment, the flow volume can be adjusted within a range in which waste can be conveyed from the bowl portion 12. By making this second flow volume less than the first low-volume, discharge of waste floating in the bowl portion 12 with a lower flow volume allows for greater water conservation, as well as a quieter operation due to the reduced sound of water spouting from the jet water spouting port 16. Moreover, the inertial force of the pressurizing pump 122 is reduced by lowering the rpm of the pressurizing pump 122; reducing the pressurizing pump 122 inertial force means that a smaller amount of flush water is sufficient to be drawn in from the reservoir tank 120, so that even though the size of the reservoir tank 120 is made smaller, sucking in of air by the pressurizing pump 34 in what is known as "air cavitation" can be prevented.

In the fifth embodiment, as in the above-described third embodiment, a similar first pattern, second pattern, and/or third pattern can be executed by adjusting the second flow volume to various values.

Next, at time t10, at which point a predetermined time interval (e.g. 5 seconds) has elapsed from time t5, the pressurizing pump 122 is set to rotate at low speed (e.g. 1000 rpm). At the same time, a water supply path switching valve 136 is switched from the both sides open position to the rim-side fully open position. The rpm of the pressurizing pump 122 is slowly reduced during the period from time t10 to time t11 so as to gradually reduce the spouting of water from the jet water spouting port 16. The siphon cutoff sound generated by a sudden interruption in siphon action can thus be prevented (particularly in the first pattern).

At time t11, jet water spouting has ended, but rim water spouting continues as before.

Next, at time t12, when the flush water level in the reservoir tank 120 falls to water level L3 and the bottom end float switch 164*b* turns ON, the pressurizing pump 122 stops operating. After this time t12, the pressurizing pump 122 is in a stopped state, but the electromagnetic on/off valve 134 is still in an open state, therefore subsequent to time t12 the reservoir tank 120 is being replenished with flush water (the tank is being supplied with water).

Next, the top end float switch 164*a* turns ON as a result of the rise of the water level in the reservoir tank 120 and thereafter, at time t15, the electromagnetic on/off valve 134 is OFF and flush water is stopped from flowing into the reservoir tank 120.

At this time t15, the water supply line switching valve 136 is in a rim-side fully open position, and [the system] is restored to the standby state (the same state as at time t0).

Although the present invention has been explained with reference to a specific, preferred embodiment, one of ordinary skill in the art will recognize that modifications and improvements can be made while remaining within the scope and spirit of the present invention. The scope of the present invention is determined solely by the appended claims.

What is claimed is:

1. A flush toilet cleaned by pressurized flush water, said flush toilet comprising:

a toilet main unit provided with a bowl portion, a rim water spouting port and jet water spouting port both for expelling flush water, and a drain trap pipe;

a reservoir tank for storing flush water;

rim spout water supply means for supplying flush water to the rim water spouting port at a predetermined timing;

reservoir water supply means for supplying flush water to the reservoir tank at a predetermined timing;

a pressurizing pump for pressurizing flush water stored in the reservoir tank and supplying the flush water to the jet water spouting port; and control means for controlling the operation of the pressurizing pump and the rpm thereof so as to control the flow speed and the flow volume of flush water spouted from the jet water spouting port;

wherein the drain trap pipe includes an inlet portion, a trap ascending pipe rising from the inlet portion, and a trap descending pipe dropping from the trap ascending pipe;

the jet water spouting port is disposed approximately horizontally, pointing toward the inlet portion of the drain trap pipe; and the control means controls the rpm of the pressurizing pump so that a first flow volume, configured to generate a first siphon action, is spouted from the jet water spouting port, and then a second flow volume, configured to generate a second siphon action which is weaker than the first siphon action, is spouted from the jet water spouting port continuously after the first flow volume being spouted, so as to generate a flow speed capable of conveying waste and to seal a cross section at some location of the drain trap pipe, prior to the end of the first siphon action generated by the first flow volume, thereby continuing the siphon action when the first flow volume and the second flow volume have been spouted.

2. The flush toilet according to claim 1, wherein the control means controls the rpm of the pressurizing pump such that the second flow volume is smaller than the first flow volume.

3. The flush toilet according to claim 1, wherein the control means controls the rpm of the pressurizing pump in such a way that water spouted from the jet water spouting port gradually decreases when spouting of the second flow volume ends.

4. The flush toilet according to claim 1, wherein the first flow volume is between 75-120 liters/minute.

5. The flush toilet according to claim 1, wherein the flow speed of flush water spouted from the jet water spouting port by the pressurizing pump controlled by the control means is between 3.0-6.2 meters/second.

6. A flush toilet cleaned by pressurized flush water, said flush toilet comprising:

a toilet main unit provided with a bowl portion, a rim water spouting port and jet water spouting port for expelling flush water, and a drain trap pipe;

a reservoir tank for storing flush water;

rim spout water supply means for supplying flush water to the rim water spouting port at a predetermined timing;

reservoir water supply means for supplying flush water to the reservoir tank at a predetermined timing;

pressurizing means for pressurizing flush water stored in the reservoir tank and supplying the flush water to the jet water spouting port; and control means for controlling the operation of the pressurizing means and controlling the pressure generated by the pressurizing means so as to control the flow speed and flow volume of flush water spouted from the jet water spouting port;

wherein the drain trap pipe includes an inlet portion, a trap ascending pipe rising from the inlet portion, and a trap descending pipe dropping from the trap ascending pipe;

the jet water spouting port is disposed approximately horizontally, pointing toward the inlet portion of the drain trap pipe; and the control means controls the pressure generated by the pressurizing means so that a first flow volume, configured to generate a first siphon action is spouted from the jet water spouting port, and then a second flow volume, configured to generate a second siphon action which is weaker than the first siphon action, is spouted from the jet water spouting port continuously after the first flow volume being spouted, so as to generate a flow speed capable of conveying waste and to seal a cross section at some location of the drain trap pipe, prior to the end of the first siphon action generated by the first flow volume, thereby continuing the siphon action when the first flow volume and the second flow volume have been spouted.

7. The flush toilet according to claim 6, wherein the control means controls the volume pressurized by the pressurizing means so that water spouted from the jet water spouting port gradually decreases when spouting of the second flow volume from the jet water spouting port ends.

8. The flush toilet according to claim 6, wherein the first flow volume is between 75-120 liters/minute.

9. The flush toilet according to claim 6, wherein the flow speed of flush water spouted from the jet water spouting port by the pressurizing means under the control of the control means is between 3.0-6.2 meters/second.

* * * * *